US009366102B2

(12) United States Patent
Varney

(10) Patent No.: US 9,366,102 B2
(45) Date of Patent: Jun. 14, 2016

(54) ANTI-ALTERATION WELLHEAD VAULT

(71) Applicant: Paul Varney, Petersham, MA (US)

(72) Inventor: Paul Varney, Petersham, MA (US)

( * ) Notice: Subject to any disclaimer, the term of this patent is extended or adjusted under 35 U.S.C. 154(b) by 29 days.

(21) Appl. No.: 14/213,933

(22) Filed: Mar. 14, 2014

(65) Prior Publication Data

US 2014/0238691 A1 Aug. 28, 2014

Related U.S. Application Data

(63) Continuation-in-part of application No. 13/789,428, filed on Mar. 7, 2013.

(60) Provisional application No. 61/608,044, filed on Mar. 7, 2012, provisional application No. 61/794,935, filed on Mar. 15, 2013, provisional application No. 61/810,662, filed on Apr. 10, 2013, provisional application No. 61/898,339, filed on Oct. 31, 2013.

(51) Int. Cl.
*E21B 33/03* (2006.01)
*E21B 41/00* (2006.01)

(52) U.S. Cl.
CPC ..... *E21B 33/03* (2013.01); *E21B 41/0021* (2013.01)

(58) Field of Classification Search
CPC ..... E21B 33/03; E21B 41/0021; E21B 33/00; E21B 33/035; E21B 43/01
See application file for complete search history.

(56) References Cited

U.S. PATENT DOCUMENTS 2,835,328 A * 5/1958 Thompson ..... E21B 7/18 166/157
2011/0274493 A1* 11/2011 Cutts ..... E21B 43/0122 405/60

* cited by examiner

*Primary Examiner* — Yong-Suk (Philip) Ro
(74) *Attorney, Agent, or Firm* — Gerry A. Blodgett; David J. Blodgett; Blodgett & Blodgett, P.C.

(57) ABSTRACT

A wellhead vault for preventing alteration of the wellhead of a water supply. The vault is a heavy bell-shaped structure, formed of concrete, and having a downwardly facing concavity, and the vault placed over, with the concavity around the wellhead. The vaults too heavy to be removed by human lifting. Lifting elements are provided to allow the vault to be installed and removed by heavy construction equipment. The vault has a vent that communicates between the concavity and the outside, allowing air, but not liquid, liquid or solid contaminants, or animals, to pass through.

23 Claims, 18 Drawing Sheets

ANTI-ALTERATION WELLHEAD VAULT

STATEMENT REGARDING FEDERALLY SPONSORED RESEARCH OR DEVELOPMENT

This invention has been created without the sponsorship or funding of any federally sponsored research or development program.

CROSS-REFERENCE TO RELATED APPLICATIONS

NA.

FIELD OF THE INVENTION

This invention involves a system for protecting wellheads that are part of water supplies.

BACKGROUND OF THE INVENTION 40 years ago, there seemed to be no terrorist threat, but in today's world it seems we have people and groups of people that will stop at nothing to hurt, maim and kill others, even children. This invention involves a wellhead that is protected by an anti-alteration well vault. The vault enhances the security of our precious water supply and protects the safety of water supply consumers. This protected wellhead will go a long way toward protecting municipal and private well water supplies and could be used also to protect oil or gas wells, whether active or abandoned, from alteration, including not only tampering, vandalism, and terrorism, but also intentional and unintentional damage and intrusion by both human and non-human perpetrators.

It is common and usually necessary, in the provision of well water to a small community water system, to have a portion of the water delivery system, including upper end of the well and associated connections, above ground. This portion is known as a wellhead. The wellhead provides an air source in order for the pump to function properly and the final connection from the water supply to a private dwelling is attached at the wellhead. The wellhead is frequently located in unobtrusive, sparsely populated areas and therefore extremely vulnerable to malicious vandalism and terrorism, and various kinds of accidents.

Although various locking mechanisms and security chain systems have been used to protect wellheads from malicious tampering, easily available portable power tools can defeat most of these protections easily, quickly, and inconspicuously. This invention effectively decreases the possibility of a terrorist or local malicious vandal covertly tampering with the water supply through the wellhead.

These and other difficulties experienced with the prior art devices have been obviated in a novel manner by the present invention.

It is, therefore, an outstanding object of some embodiments of the present invention to provide a system for protecting the wellhead of a water supply from undesired alteration, both intentional and accidental, and including vandalism and terrorism.

It is another outstanding object of some embodiments of the present invention to provide a system for protecting the wellhead of a water supply from undesired alteration, that is cost-efffective.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

A wellhead vault for preventing alteration of the wellhead of a water supply. The vault is a heavy bell-shaped structure, formed of concrete, and placed over and around the wellhead. The vaults too heavy to be removed by human lifting. Lifting elements are provided to allow the vault to be installed and removed by heavy construction equipment. The invention may be perceived as the vault itself, the vault and wellhead combination, and the method of using the vault on the wellhead.

This invention is a wellhead enclosure formed of a relatively immoveable, indestructible well vault which prevents malicious or accidental access to the attached supply system.

One embodiment of the invention includes a wellhead enclosure formed of a heavy bell shaped pre-formed concrete vault that has been lifted in place using heavy lifting equipment. The vault is constructed from a material that would require a noisy and conspicuous effort to penetrate. Furthermore, the well vault is of such a weight that it can only be moved using heavy-duty construction equipment, use of which would also necessarily be noisy and conspicuous.

One benefit of this invention is that, along with anti-tampering protection, it also protects the vulnerable exposed wellhead from accidental damage from a vehicle or a piece of heavy equipment colliding with the wellhead itself. The mass of the well vault will repel the vehicle.

Also, the top portion the well vault could be made dome-shaped in order to improve the run-off of rain and snow causing far less weather related degradation of the enclosure. Or it could be made flat to form a shelf for placing objects. Or it could be concave to form a bird bath. The exterior of the well vault could be decorated before or after casting to make it look attractive when that is appropriate.

BRIEF DESCRIPTION OF THE DRAWINGS

The character of the invention, however, may best be understood by reference to one of its structural forms, as illustrated by the accompanying drawings, in which:

FIG. 11 shows the flotation ball in its lower position in which air is allowed to pass in and out of the vent.

FIG. 12 shows the flotation ball in its upper position in which water is not allowed to pass through the vent, and into the wellhead chamber.

FIG. 13 shows both flotation balls in their lower positions in which air is allowed to pass in and out of the vent.

FIG. 14 shows the lower flotation ball in its upper position in which water cannot pas through the vent, and the upper flotation ball in its lower position in which air would be allowed to pass in and out of the vent, were it not for the lower check value.

FIG. 15 shows both of the flotation balls in their upper positions in which neither air nor water allowed to pass through the vent, into the chamber.

DETAILED DESCRIPTION OF THE INVENTION

Figure 1:
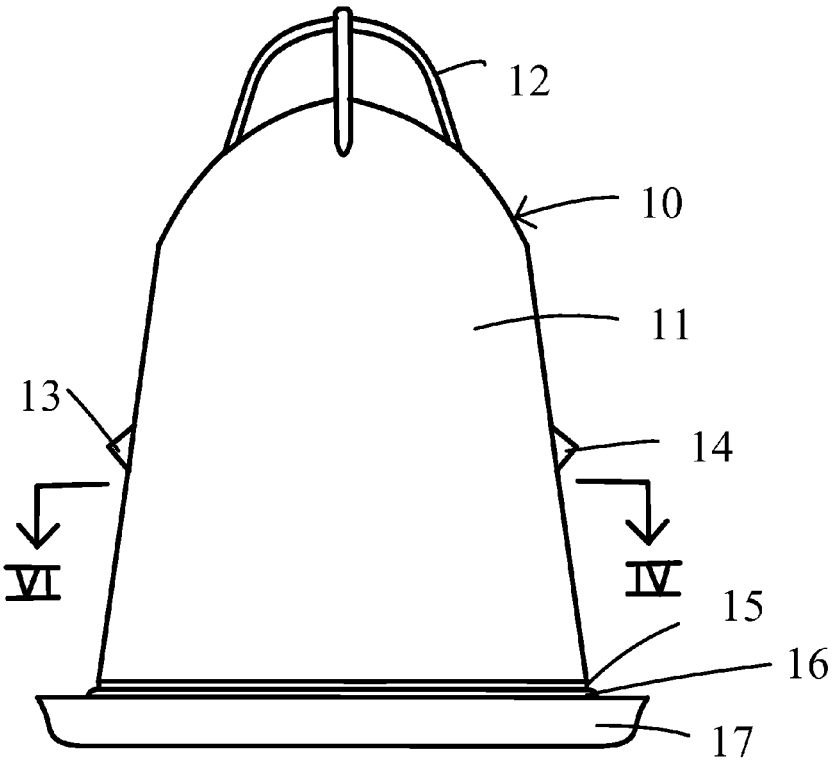
FIG. 1 is a front elevation view of an embodiment of a wellhead vault of the present invention.

One embodiment of the anti-alteration wellhead vault of the present invention is an inverted bell-shaped concrete structure that encloses the upper, exposed, end of a well, and the vault's heavy concrete construction is designed to prevent the enclosure from being moved by individuals without the assistance of heavy equipment. Although concrete is the preferred material from which this vault is manufactured, any relatively dense material such as metal, or composite polymeric materials, such as sand or gravel mixtures in a polymer matrix, could also be used.

One embodiment of the well cover is constructed using cast concrete including cast-in re-bar (reinforcement bar) lifting loops, and weighs approximately 1200 pounds. Its primary purpose is to protect the drinking water well from tampering as well as keeping rodents and other creatures from accessing the metal well cap which is usually vented. The well cover is constructed to be too heavy for a few individuals to remove easily. Moving and positioning of the well vault must be done with heavy equipment such as a backhoe or excavator, thereby making surreptitious removal difficult. Currently, a typical 6" diameter artesian drilled well is covered by a metal cap weighing approximately 10 pounds which is secured with 6 to 10 bolts. A terrorist or vandal can easily and surreptitiously remove this type of protective cap in order to facilitate contamination of the water supply and easily replace the well cap with very little difficulty. When the attached supply pump is actuated, it will pump contaminated water into the institution or home that has been targeted.

Although the above embodiment is designed to protect a 6" inch diameter well, it is envision that similar well cover can be made of dimensions appropriate to well sizes typically servicing schools, businesses, municipalities and individual home owners who are concerned about potential contamination, tampering or vandalism of their source of drinking water.

In another embodiment of the well vault cover, includes a screen mesh laid over the well opening extending beyond the circumference of the well opening such that when the well cover is positioned over the well opening, such that the screen mesh is secured in place and a seal is created between the screen mesh and the well cover thereby preventing rodents from burrowing under the well cover and gaining access to the wellhead.

In another embodiment of the well vault cover, includes placing a liquid-tight seal on the bottom surface of the well vault so that the well vault resists penetration by flood water. A special liquid-blocking vent system can be employed to prevent flood water from entering the vault through the vents.

In another embodiment the well cover includes one or more air vent pipes that penetrate the well cover wall and are oriented such that the entrance to the air vent pipe located at the surface of the well cover is lower relative to the exit of the air vent pipe into the inner cavity. This orientation prevents liquid contaminants from being poured directly into the well cover inner cavity. The air vents guarantee sufficient airflow into the inner cavity which is required for the proper functioning of the well pump since access to air is necessary to replace the water space cavity whenever the well pump is activated.

The envisioned air vents also may include a stainless steel screen or alternatively a stainless steel porous scrubber located in the air vent pipe having securing bolts running through the screen (or scrubber) and fastened to the air vent pipe wall which act to hold the screen (or scrubber) in place. This screen prevents rodents from infiltrating the inner cavity as well as preventing larger particulate contamination from entering the cavity whether from natural sources or from malicious tampering.

The envisioned air vents may also include a vented cap securing the outside entrance of the air vent. This provides a barrier to rodent infiltration and malicious tampering of the well through the air vents themselves.

The envisioned air vents may also include one or more jogs in the air vent pipe which increases the difficulty of a malicious individual accessing the wellhead chamber with the intent to tamper with it in some manner.

The dimensions depend on enveloping the wellhead, and achieving sufficient weight to make the vault difficult to move without heavy equipment. In one specific embodiment the vault is a conical bell shaped with rounded top, height 3', 34" base outer diameter, tapering up to 27" outer diameter, with rounded top above that. Wall thickness is about 7" at the base, tapering up to 3½", thereby forming inner chamber centered in vault with height 18" and diameter of 18". The dimensions of the inner chamber is 18" width-diameter. The height of the chamber is 18". The construction material is re-formed concrete. The steel rod options are reinforcement bar (re-bar), or other kinds of steel bars available. The depth of steel rod in vault wall is sufficient to support the weight of the vault.

Referring to the included drawings, FIG. 1 is a front elevation view of an embodiment of a wellhead vault of the present invention. The anti-alteration wellhead vault system, designated generally by the 10, includes precast concrete bell-shaped vault 11. The vault 11 has lifting elements 12 mounted on the top of the vault 11. The lifting element 12 is in the form of loops of metal bars the ends of which are embedded in the concrete of the vault 11. The lifting elements 12 allow the vault 11 to be placed and lifted using heavy construction equipment. The vault 11 also includes air vents 13 and 14.

The vault is sitting on a layer of sealing material 15, that is positioned between the bottom 16 of the vault 11 and a flat concrete pad 17. The pad 17 is buried in the ground 18.

Figure 2:
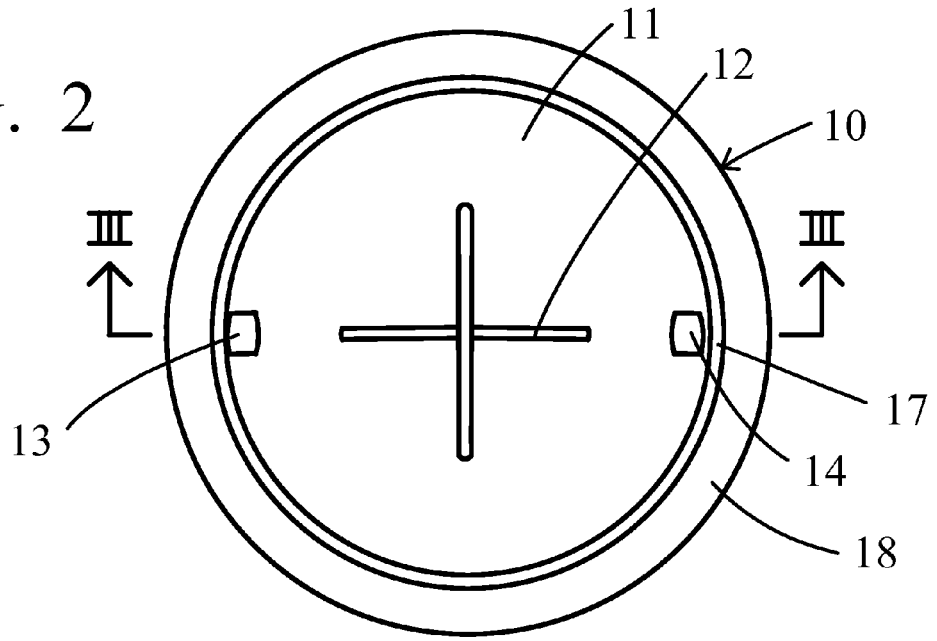
FIG. 2 is a plan view of the wellhead vault shown in FIG. 1.

FIG. 2 is a plan view of the wellhead vault shown in FIG. 1. The vault system 10 includes the vault 11. The vault 11 includes the lifting element 12, and the air vents 13 and 14. The vault 11 is sitting on the concrete pad 17 which is positioned in the ground 18.

Figure 3:
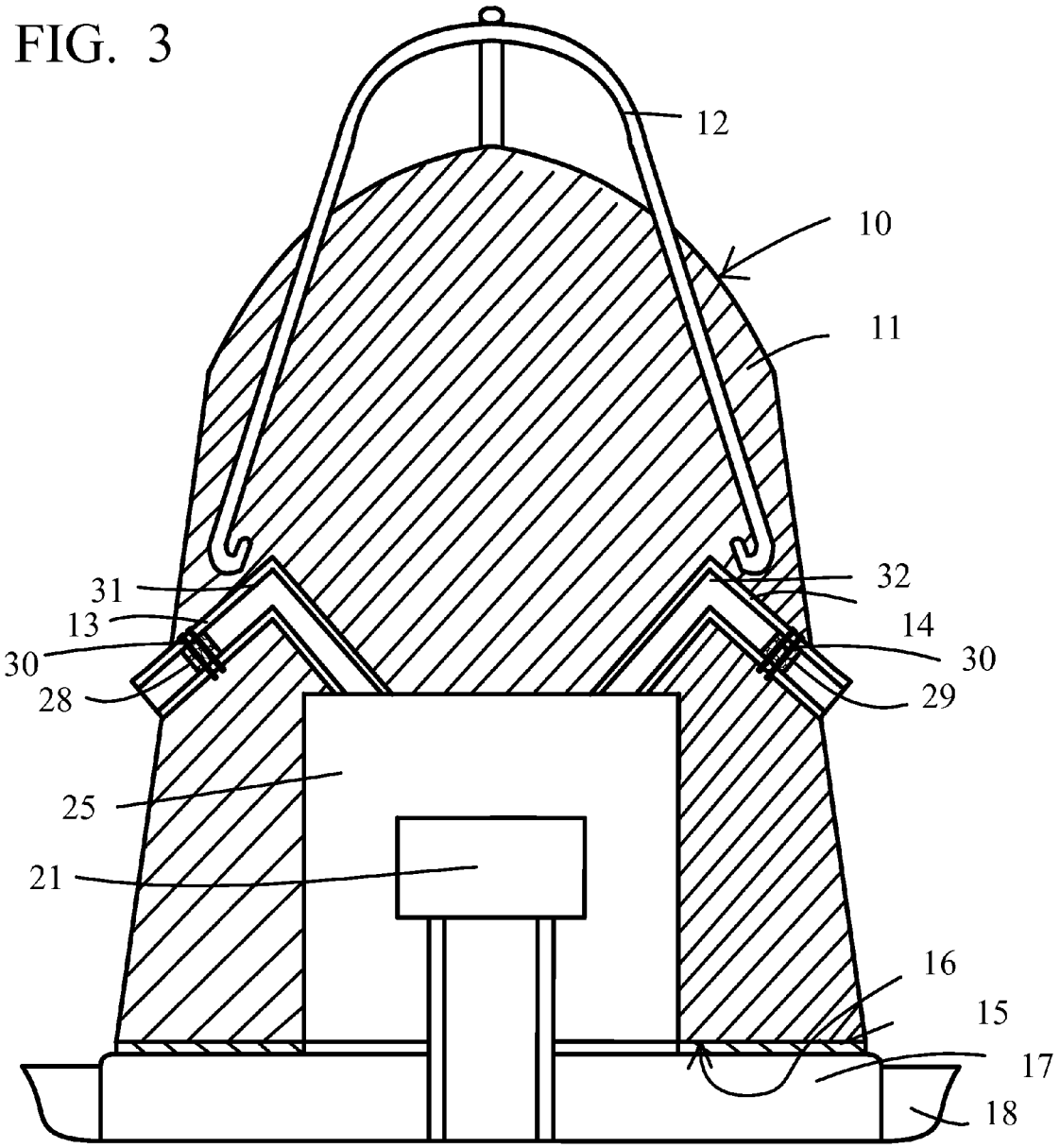
FIG. 3 is a sectional front elevation view of the wellhead vault shown in FIG. 1, as seen along the view line III-III of FIG. 2.

FIG. 3 is a sectional front elevation view of the wellhead vault shown in FIG. 1, as seen along the view line III-III of FIG. 2. The anti-alteration wellhead vault system, designated generally by the 10, includes precast concrete bell-shaped vault 11. The vault 11 has lifting elements 12 mounted on the top of the vault 11. The lifting element 12 is in the form of loops of metal bars the ends of which are embedded in the concrete of the vault 11. Preferably, the ends of the metal bars will be bent around to form hooks that will prevent the bars from being pulled out of the concrete. The lifting elements 12 allow the vault 11 to be placed and lifted using heavy construction equipment. The vault 11 also includes air vents 13 and 14.

The bottom 16 of the vault 11 is sitting on a layer of sealing material 15, that is positioned between the bottom 16 of the vault 11 and a flat concrete pad 17. The pad 17 is buried in the ground 18.

The wellhead 21 emerges from the ground 18 through the flat concrete pad 17, and stands substantially above the top of the concrete pad 17.

The vault 11 is shaped to form a hollow downwardly-opening wellhead chamber 25. The vault 11 is positioned so that the wellhead 21 is within the wellhead chamber, where it is protected from alteration by the vault 11.

The vault 11 includes air vent pipes 13 and 14 that penetrate the vault 11 wall, from the outer surface of the vault 11 to the wellhead chamber 25. The vents 13 and 14 are oriented such that the entrance to the air vent pipe located at the outer surface of the vault 11 is lower relative to the exit of the air vent pipe into the wellhead chamber 25. This orientation prevents liquid contaminants from being poured directly into the well cover inner cavity. The air vents guarantee sufficient airflow into the wellhead chamber 25 which is required for the proper functioning of the well pump since access to air is necessary to replace the water space cavity whenever the well pump is activated.

Each of the vents 13 and 14 also may include an air-porous solids trap 28 and 29, such as a stainless steel screen or alternatively a stainless steel porous scrubber located in the air vent pipe having securing bolts 30 running through the screen (or scrubber) and fastened to the air vent pipe wall which act to hold the screen (or scrubber) in place. This screen prevents rodents from infiltrating the inner cavity as well as preventing larger particulate contamination from entering the cavity whether from natural sources or from malicious tampering.

The air vents 13 and 14 may also include one or more jogs 31 and 32 in the air vent pipe, so that there is no straight-through path through the vent, which increases the difficulty of a malicious individual accessing the wellhead chamber with the intent to tamper with it in some manner.

Figure 4:
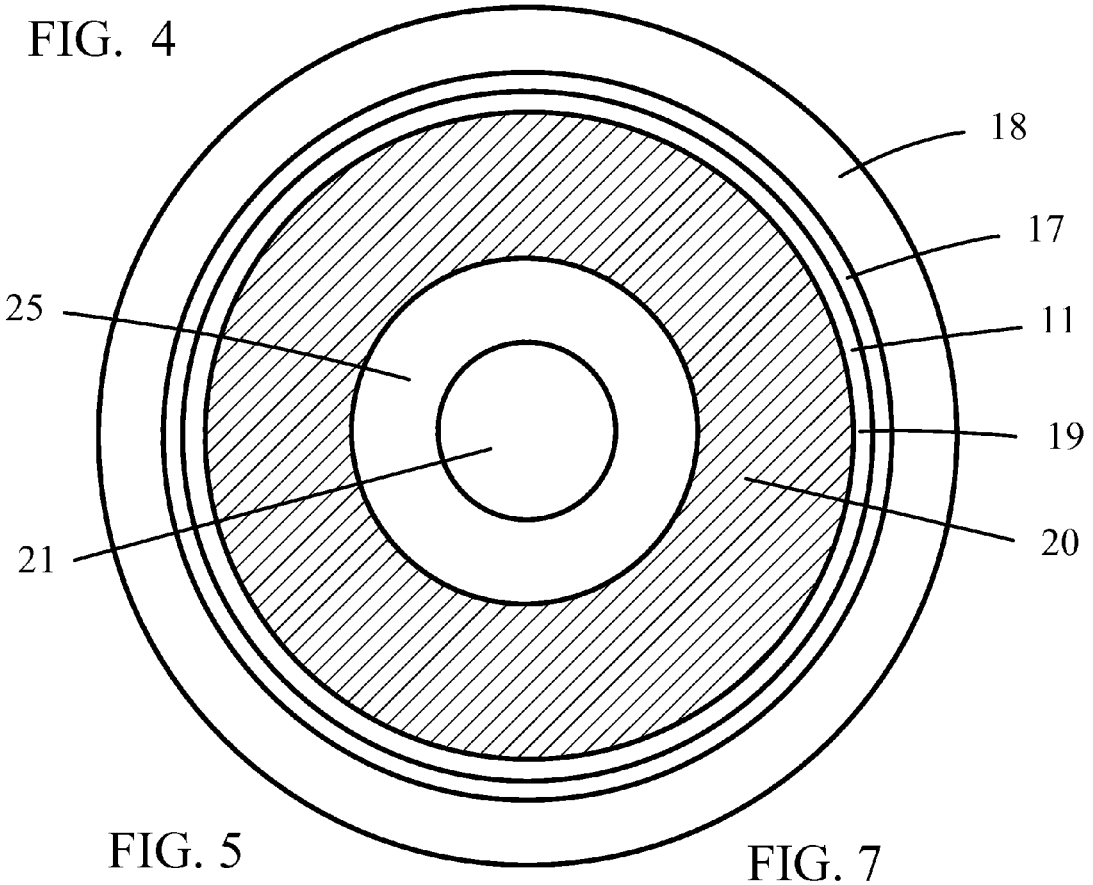
FIG. 4 is a sectional plan view of the wellhead vault shown in FIG. 1, as seen along view line IV-IV of FIG. 1.

FIG. 4 is a sectional plan view of the wellhead vault shown in FIG. 1, as seen along view line IV-IV of FIG. 1. The outer ring is the ground 18, and, moving inward, are the concrete pad 17, the outer wall 19 of the vault 11, the sectioned inner body 20 of the vault 11, the wellhead chamber 25, and the top of the wellhead 21 itself.

Figure 5:
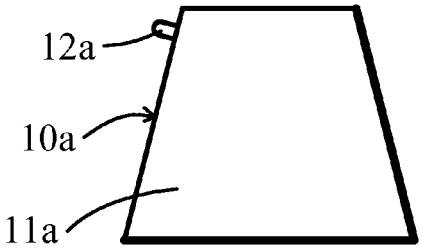
FIG. 5 is a front elevation view of a second embodiment of the present invention, having a square foot print.

FIG. 5 is a front elevation view of a second embodiment of the present invention, having a square foot print. This anti-alteration wellhead vault system, designated generally by the 10*a*, includes precast concrete bell-shaped vault 11*a*. The vault 11*a* has lifting elements 12*a* mounted on the side of the vault 11*a*. The lifting element 12*a* is in the form of a loop of a metal bar the ends of which are embedded in the concrete of the vault 11*a*. The lifting element 12*a* allows the vault 11*a* to be placed and lifted using heavy construction equipment. The vault 11*a* also includes air vents 13*a* and 14*a* (shown below).

Figure 6:
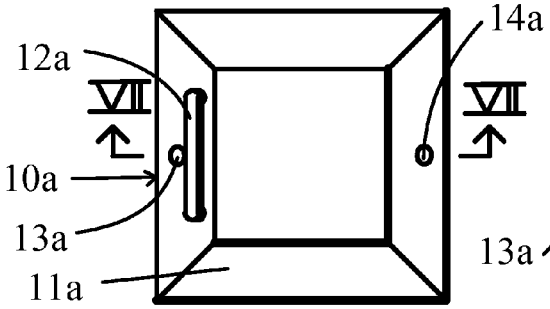
FIG. 6 is a plan view of the embodiment shown in FIG. 5.

FIG. 6 is a plan view of the embodiment shown in FIG. 5. The vault system 10*a* includes the vault 11*a*. The vault 11*a* includes the lifting element 12*a*, and the air vents 13*a* and 14*a*. The vault 11*a* might be sitting on a concrete pad which is positioned in the ground, around a wellhead.

Figure 7:
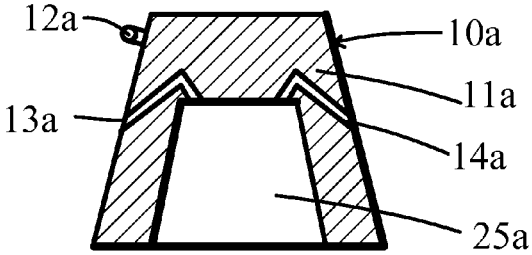
FIG. 7 is a sectional front elevation view of the embodiment shown in FIG. 5, as seen along the view line VII-VII of FIG. 6.

FIG. 7 is a sectional front elevation view of the embodiment shown in FIG. 5, as seen along the view line VII-VII of FIG. 6. The anti-alteration wellhead vault system, designated generally by the 10*a*, includes precast concrete bell-shaped vault 11*a*. The vault 11*a* has lifting elements 12*a* mounted on the side of the vault 11*a*. The lifting element 12*a* is in the form of a loop of metal bar, the ends of which are embedded in the concrete of the vault 11*a*. Preferably, the ends of the metal bar will be bent around to form hooks that will prevent the bars from being pulled out of the concrete. The lifting element 12*a* allows the vault 11*a* to be placed and lifted using heavy construction equipment. The vault 11*a* also includes air vents 13*a* and 14*a*.

Figure 8:
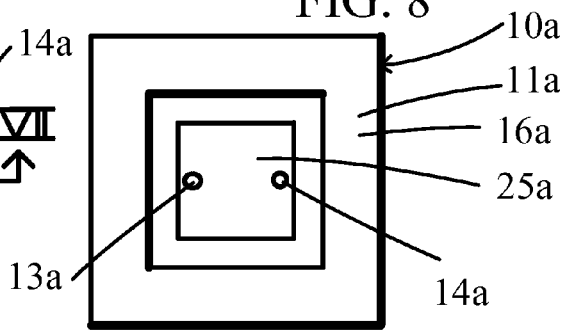
FIG. 8 is a bottom view of the embodiment shown in FIG. 5.

FIG. 8 is a bottom view of the embodiment shown in FIG. 5. The bottom view of the wellhead vault system 10*a*, shows the bottom 16*a* of the vault 11*a*, the wellhead chamber 25*a*, and the vents 13*a* and 14*a*.

Figure 9:
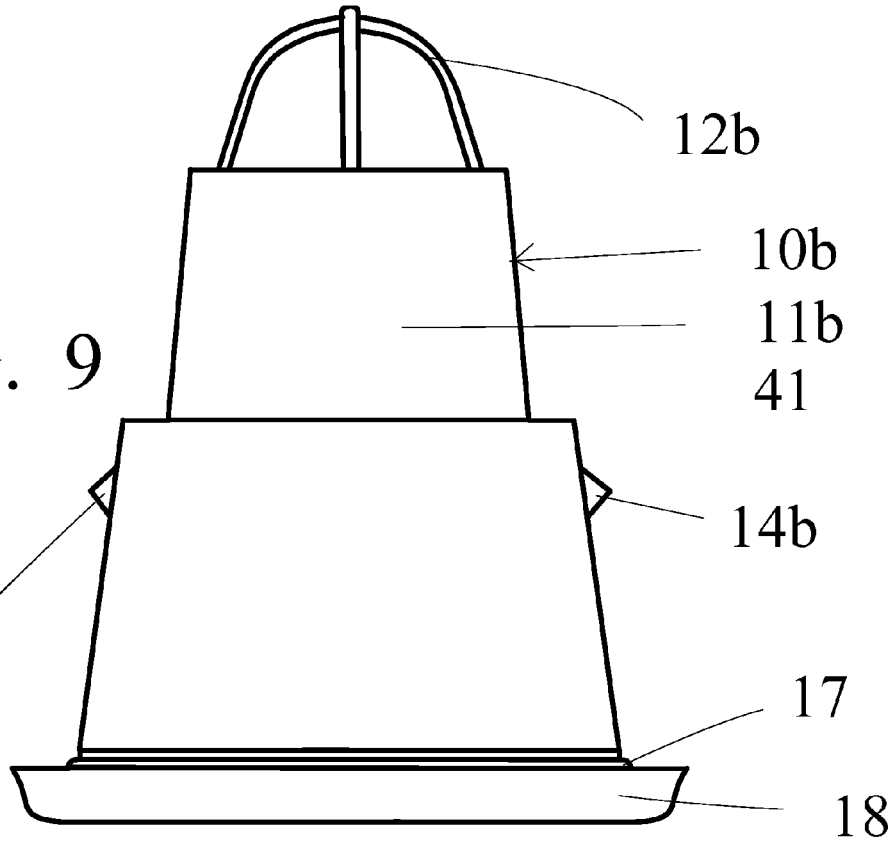
FIG. 9 is a third embodiment of the present invention in which a ledge is provided around the outside of the well vault.

FIG. 9 is a third embodiment of the well vault 11*b* present invention in which a step-like ledge 41 is provided around the outside of the well vault 11*b*. This ledge provides convenient support for a person to maintain the upper portion of the vault 11*b*, or to assist in connecting the lifting elements 12*b* to the heavy lifting equipment for positioning the vault 11*b*. This anti-alteration wellhead vault system, designated generally by the 10*b*, includes precast concrete bell-shaped vault 11*b*. The vault 11*b* has lifting elements 12*b* mounted on the top of the vault 11*b*. The lifting element 12*b* is in the form of loops of a metal bars the ends of which are embedded in the concrete of the vault 11*b*. The lifting element 12*b* allows the vault 11*b* to be placed and lifted using heavy construction equipment. The vault 11*b* also includes air vents 13*b* and 14*b*. The vault 11*b* be is sitting on a flat concrete pad 17 that is buried in the ground 18.

Figure 10:
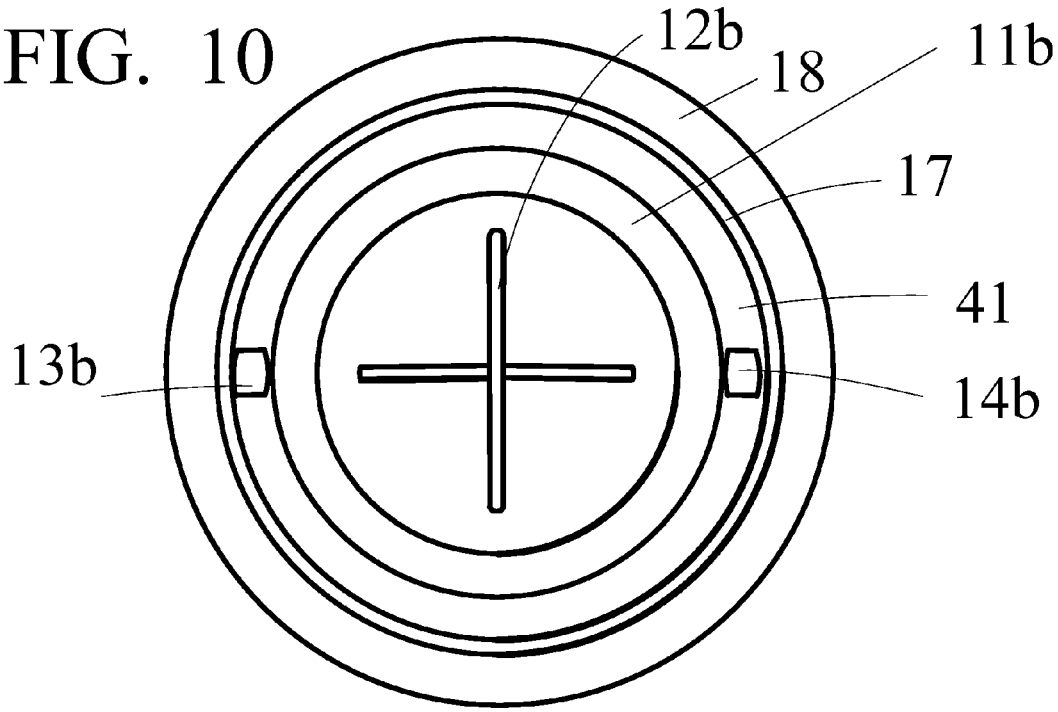
FIG. 10 is a plan view of the embodiment shown in FIG. 9.

FIG. 10 is a plan view of the embodiment shown in FIG. 9. This third embodiment of the well vault 11*b* presents invention in which a step-like ledge 41 is provided around the outside of the well vault 11*b*. This anti-alteration wellhead vault system, designated generally by the 10*b*, includes precast concrete bell-shaped vault 11*b*. The vault 11*b* has lifting elements 12*b* mounted on the top of the vault 11*b*. The lifting element 12*b* is in the form of loops of a metal bars the ends of which are embedded in the concrete of the vault 11*b*. The lifting element 12*b* allows the vault 11*b* to be placed and lifted using heavy construction equipment. The vault 11*b* also includes air vents 13*b* and 14*b*. The vault 11*b* be is sitting on a flat concrete pad 17 that is buried in the ground 18. The top of the vault os shown to be flat, but it could also be convex to allow water to drain, of concave to act as a bird bath.

Figure 11:
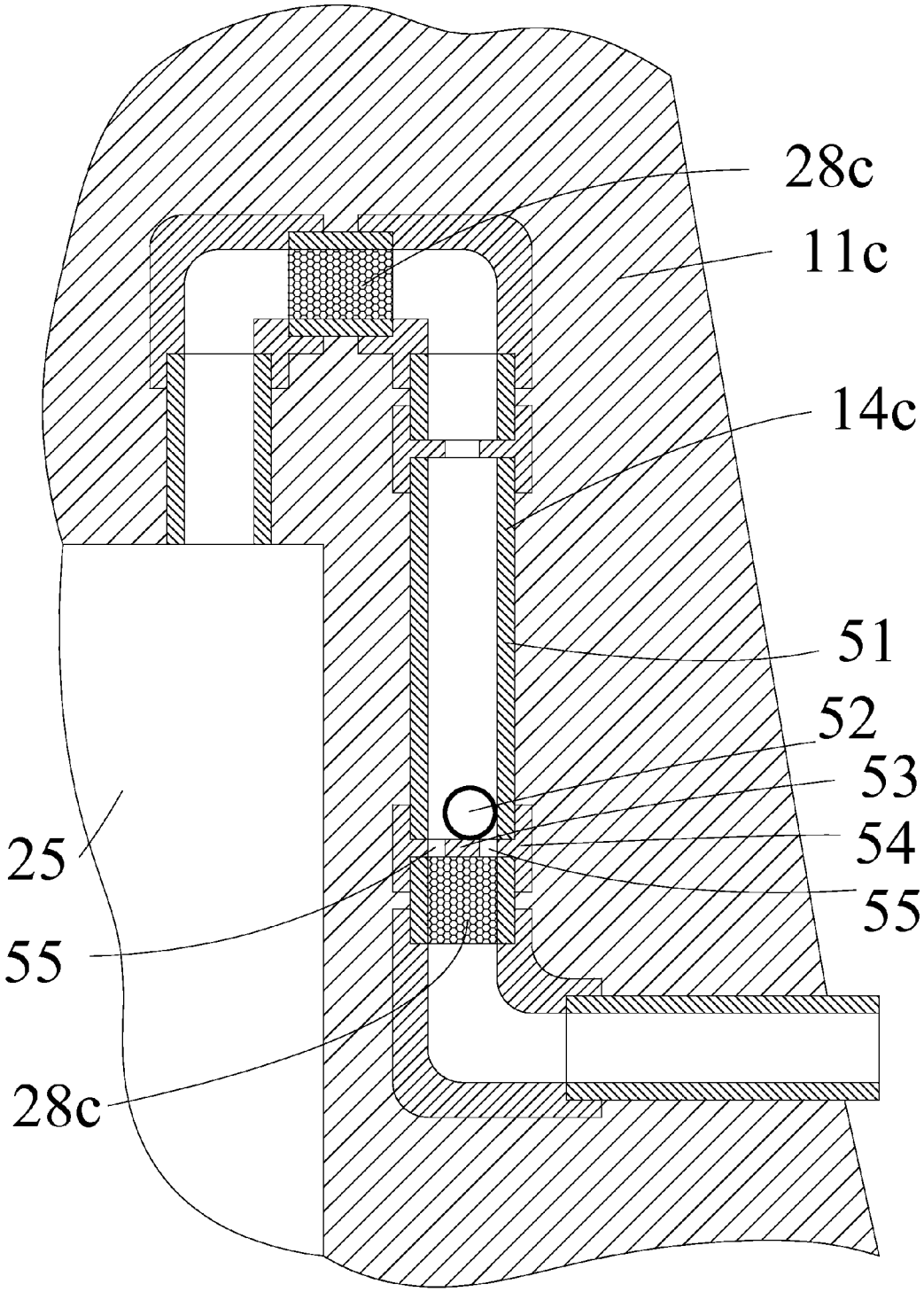
FIG. 11 is a sectional view of an alternative air vent for use in a wellhead vault embodying the principles of the present invention. This air vent is provided with a check valve that prevents flood water from entering the wellhead vault.

FIG. 11 is a sectional view of an alternative air vent 14*c* for use in a wellhead vault 11*c* embodying the principles of the present invention. This air vent is provided with a check valve 51 that prevents flood water from entering the wellhead vault 11. FIG. 11 shows the flotation ball 52 in its lower position in which air is allowed to pass in and out of the vent. The float ball 52 is sitting on a lower plate 53 that is part of a special coupling 54. The lower plate 53 extends across the bore of the vent 14*c*, and, because it has off-center bores 55, the presence of the float ball 52 on the lower plate 53, does not interfere with the flow of air through the lower plate 53. The vent 14*c* has two solids traps 28*c* to keep solid material out of the wellhead chamber 25.

Figure 12:
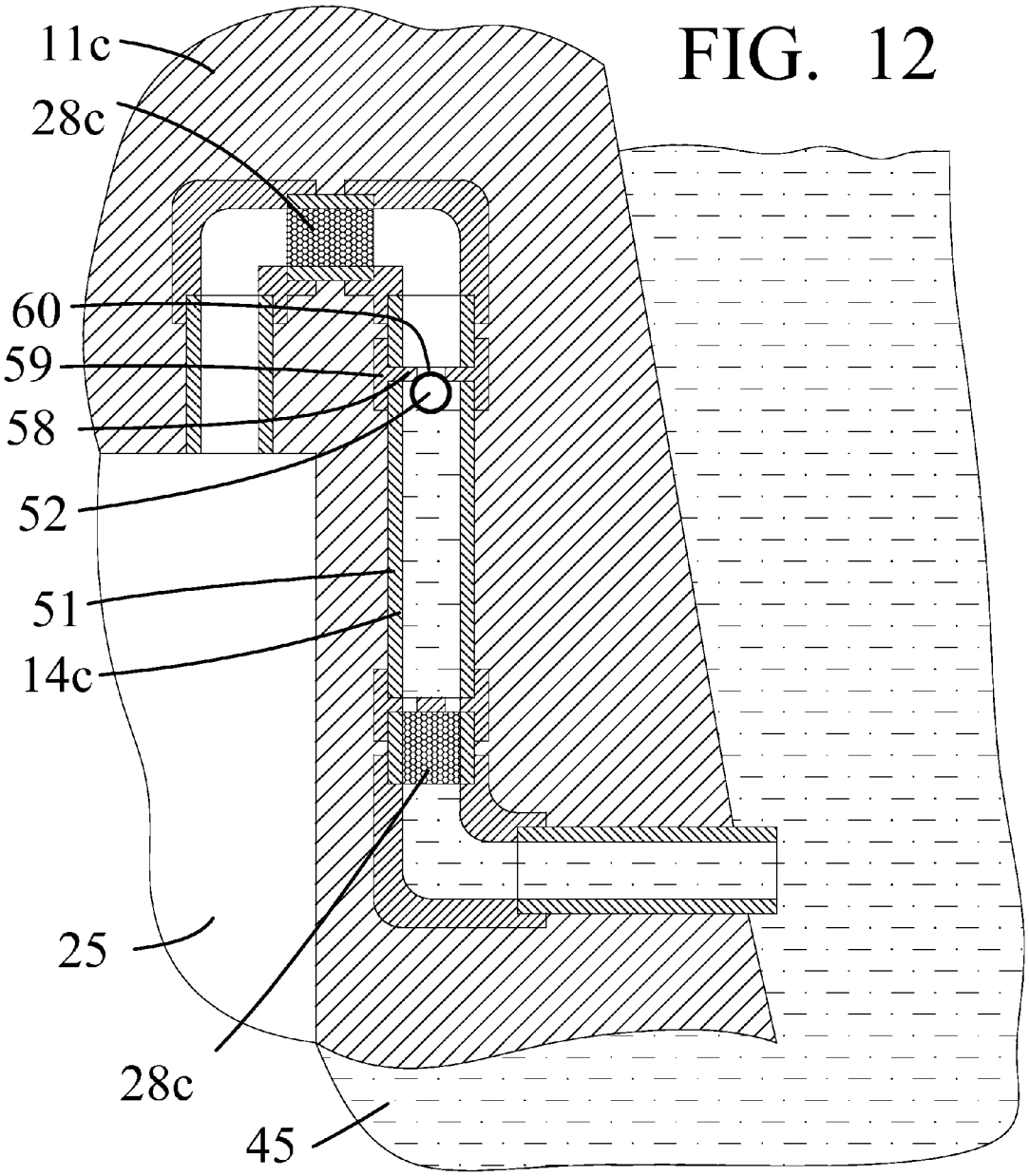
FIG. 12 is a sectional view of an alternative air vent for use in a wellhead vault embodying the principles of the present invention. This air vent is provided with a check valve that prevents water from entering the wellhead vault.

FIG. 12 is another sectional view of the alternative air vent 14*c* shown in FIG. 11, for use in a wellhead vault 11*c* embodying the principles of the present invention. In this case, flood water 45 has surrounded the vault 11*c* to the point where the wellhead chamber 25 is below water level. It would be desirable to prevent the flood water from entering the wellhead chamber 25 through the vent 14*c*. This air vent 14*c* is provided with a check valve 51 that prevents water from entering the wellhead vault 11*c*. FIG. 12 shows the flotation ball 52, pressed upward by water infiltration, into its upper position. The float ball 52 is pressed against an upper plate 58 that is part of a special coupling 59. The upper plate 58 extends across the bore of the vent 14*a*, and, because it has a center bore 60, the presence of the float ball 52 pressing against the upper plate 58, and blocking the center bore 60, stops the flow of water upward through the center bore 60 of the upper plate 58, and prevents water from passing into the wellhead chamber 25.

Figure 13:
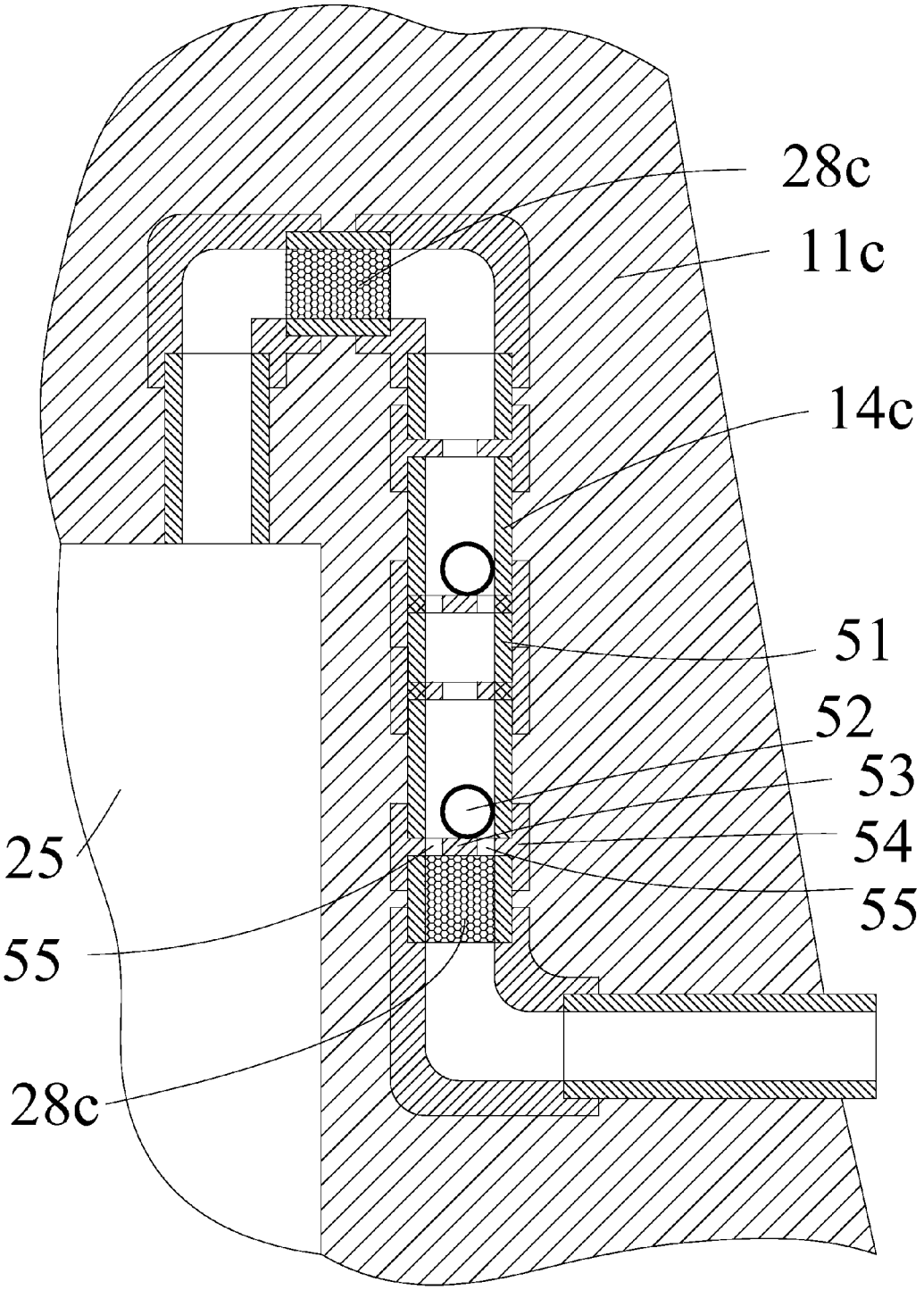
FIG. 13 is a sectional view of an alternative air vent for use in a wellhead vault embodying the principles of the present invention. This air vent is provided with a double check valve that prevents flood water from entering the wellhead vault.
Figure 14:
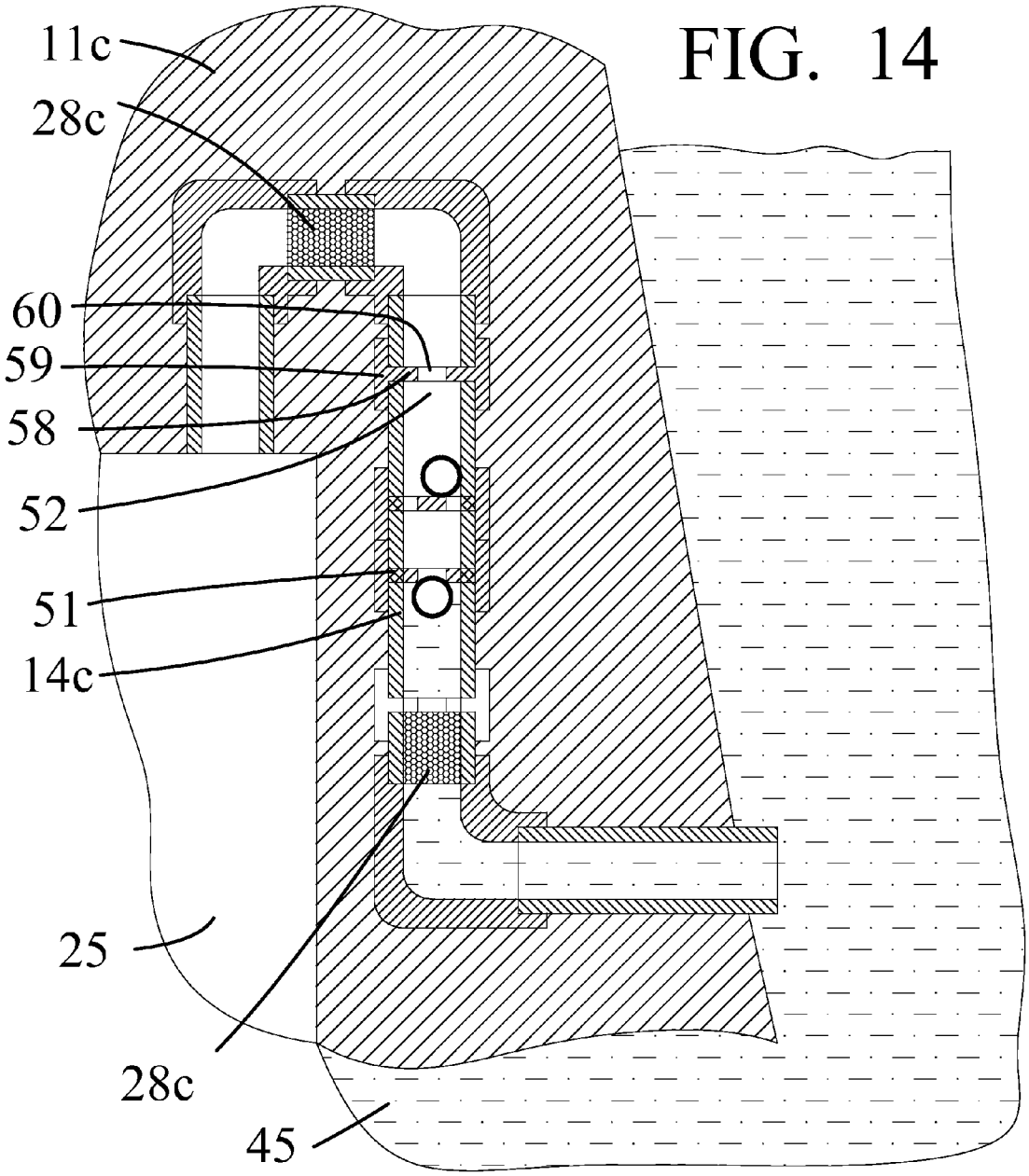
FIG. 14 is a sectional view of an alternative air vent for use in a wellhead vault embodying the principles of the present invention. This air vent is provided with a double check valve that prevents flood water from entering the wellhead vault.
Figure 15:
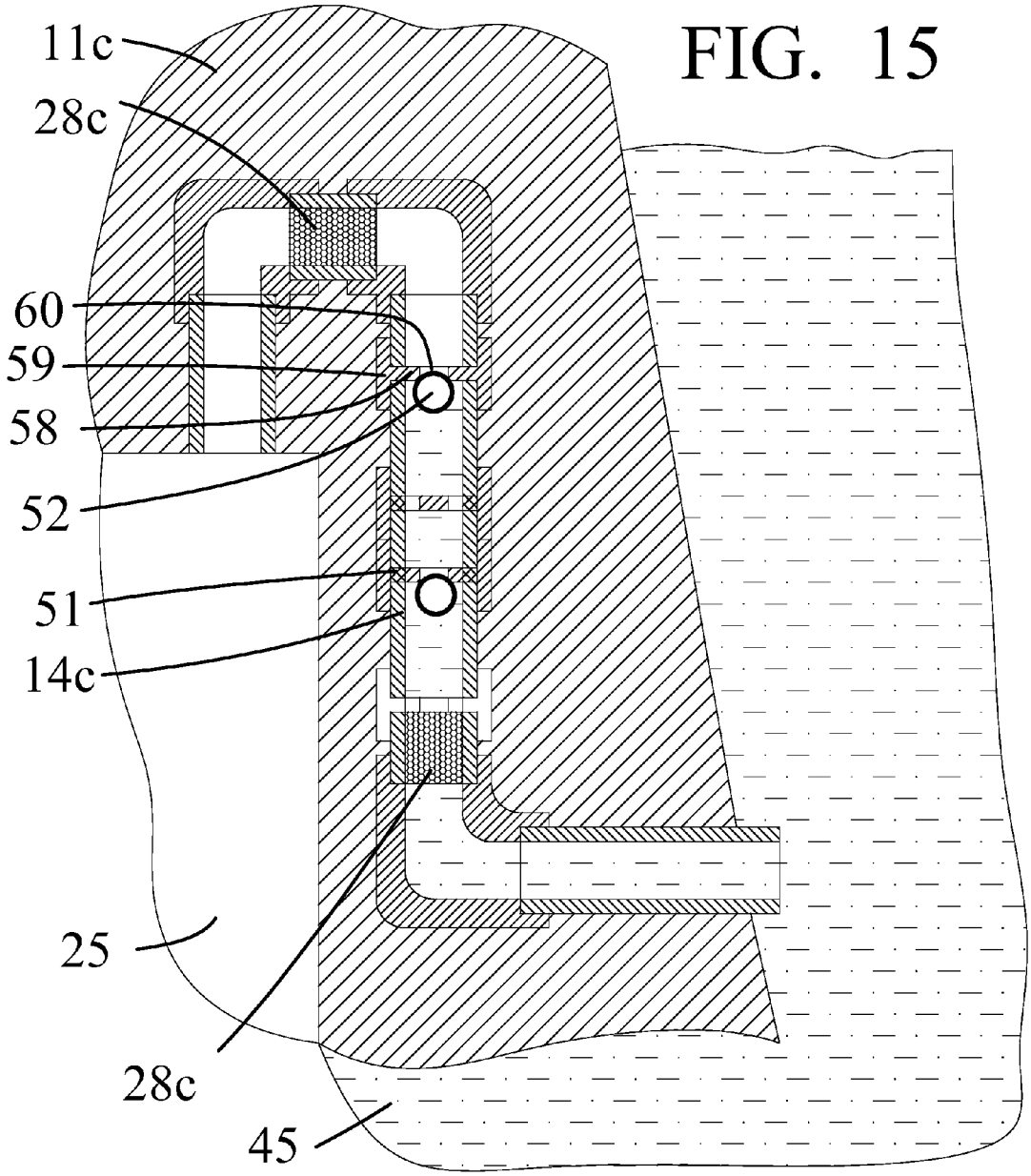
FIG. 15 is a sectional view of an alternative air vent for use in a wellhead vault embodying the principles of the present invention. This air vent is provided with a double check valve that prevents flood water from entering the wellhead vault.

FIGS. 13-15 show a variation in the vent design in which the vent is provided with a double check valve, that is, two check valves arranged one after another. One of the purposes of the check valve system is to prevent flood water from entering the valve and thereby entering the wellhead chamber. In the simple flood situations, the second check valve acts as a backup in the case where the first check valve fails to function completely. It been discovered, however, that flood waters often involve powerful surges or pressure waves of water and debry caused by the turbulence associated with rapidly moving water through complex paths. These pressure waves have pressure peaks which can overwhelmed a check valve, and pressure drops that can interfere with the normal operation of the check valve, which relies on relatively constant pressure to maintain the seal. In those pressure wave conditions, the lone check valve is not always effective. It has been discovered that, when a series of two or more check valves is employed, the first check valve absorbs the stresses of the pressure wave and protects the second check valve from the damaging effects of the flood conditions. In the case where the flood waters are highly contaminated, it becomes essential to use every effort to protect the wellhead from the contamination of the flood waters. The double check valve system provides improved protection.

FIG. 13 is a sectional view of an alternative air vent for use in a wellhead vault embodying the principles of the present invention. This air vent is provided with a double check valve that prevents flood water from entering the wellhead vault. FIG. 13 shows both flotation balls in their lower positions in which air is allowed to pass in and out of the vent.

FIG. 14 is a sectional view of an alternative air vent for use in a wellhead vault embodying the principles of the present invention. This air vent is provided with a double check valve that prevents flood water from entering the wellhead vault. FIG. 14 shows the lower flotation ball in its upper position in which water cannot pas through the vent, and the upper flotation ball in its lower position in which air would be allowed to pass in and out of the vent, were it not for the lower check value.

FIG. 15 is a sectional view of an alternative air vent for use in a wellhead vault embodying the principles of the present invention. This air vent is provided with a double check valve that prevents flood water from entering the wellhead vault. FIG. 15 shows both of the flotation balls in their upper positions in which neither air nor water allowed to pass through the vent, into the chamber.

Figure 16:
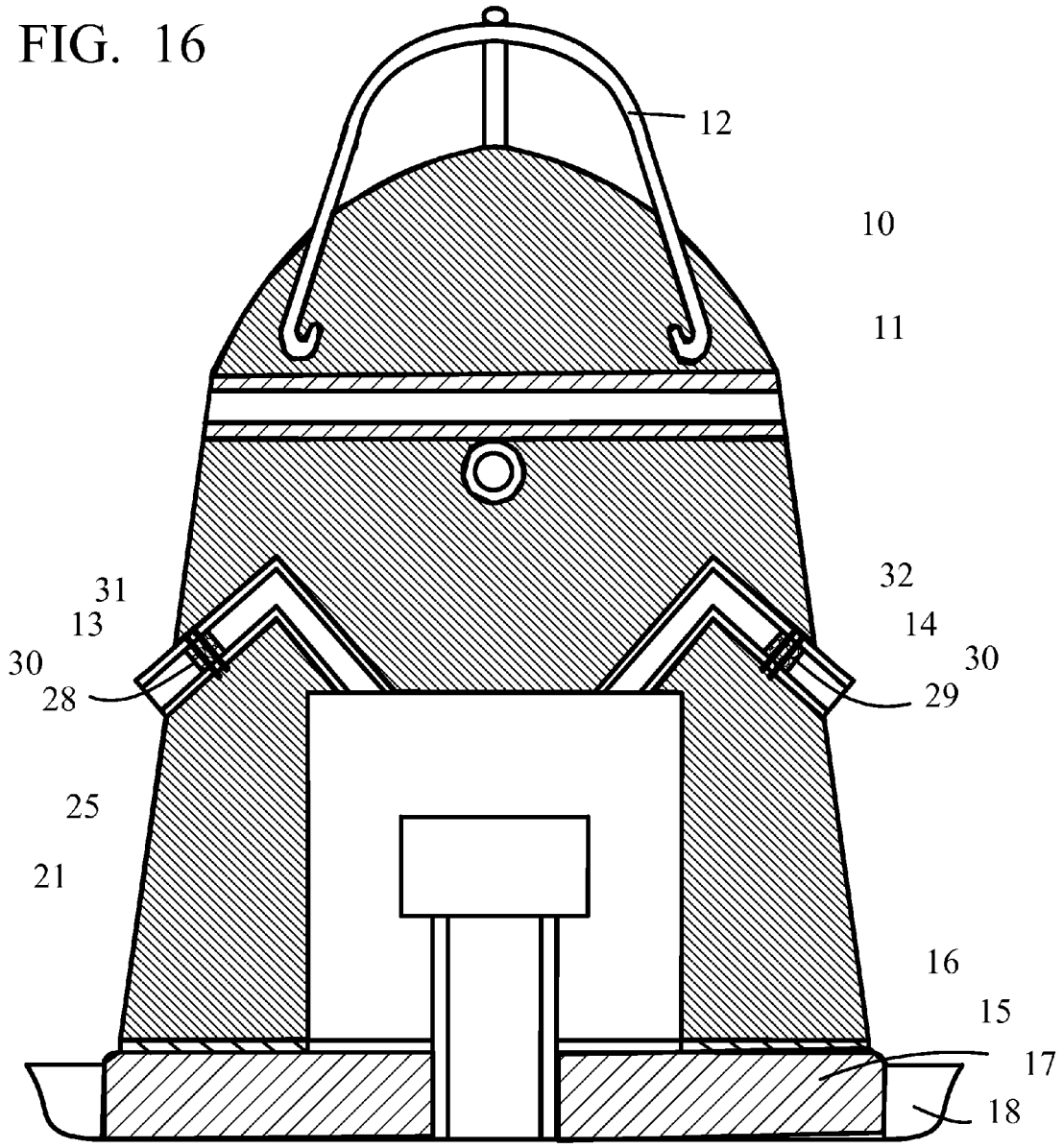
FIG. 16 is a front elevation view, in section as seen along line 16-16 of FIG. 17, of the lower end of an alternative check valve.

FIG. 16 shows a cross-sectional view of a wellhead vault, with an alternative lifting system which includes tubing set in the concrete in crossed plan view so that there are two bores through the upper portion of the wellhead vault. This alternative design could include the lifting bars or it could be built without the lifting bars. The bores allow straight lifting bars to be passed through the bores, extending on each side of the wellhead vault, so that lifting cables can be attached to those extending ends to allow lifting of the wellhead vault.

Figure 17:
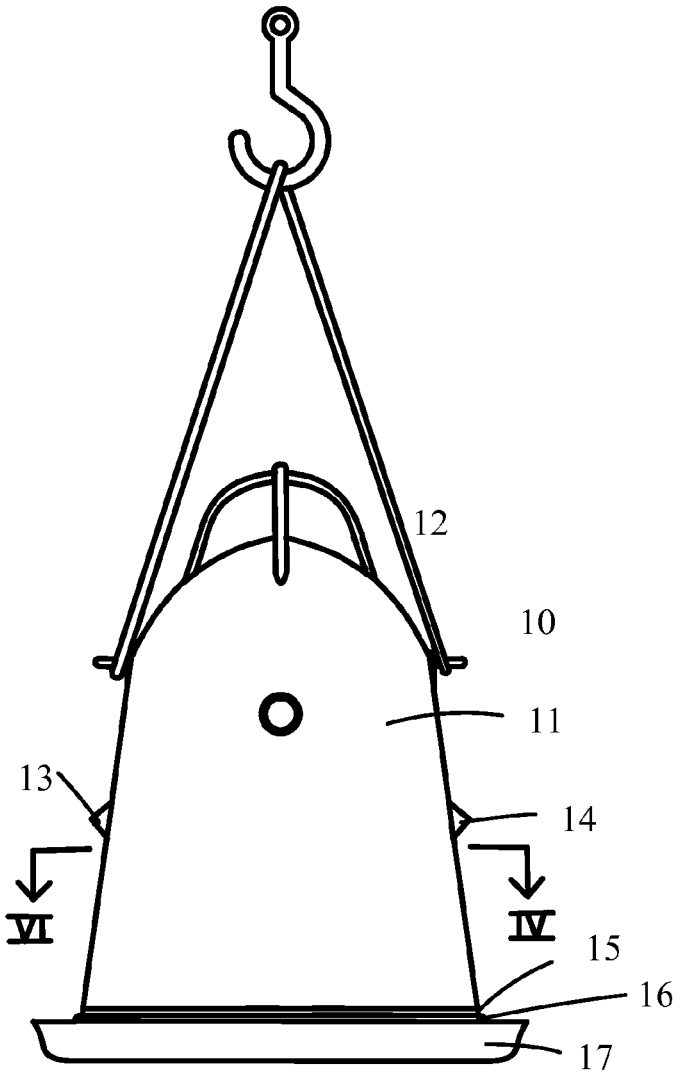
FIG. 17 is a plan view, in section as seen along line 17-17 of FIG. 16, of the lower end of the alternative check valve shown in FIG. 16.

FIG. 17 shows a front elevation view of the system shown in FIG. 16 in which lifting cables are connected to the ends of the lifting bars that extend out of each end of the bore. The lifting cables are attached to a lifting system such as a hydraulic backhoe, symbolized by the hook. This allows the wellhead vault to be installed and removed without the necessity of the embedded lifting elements, which then become optional.

Figure 18:
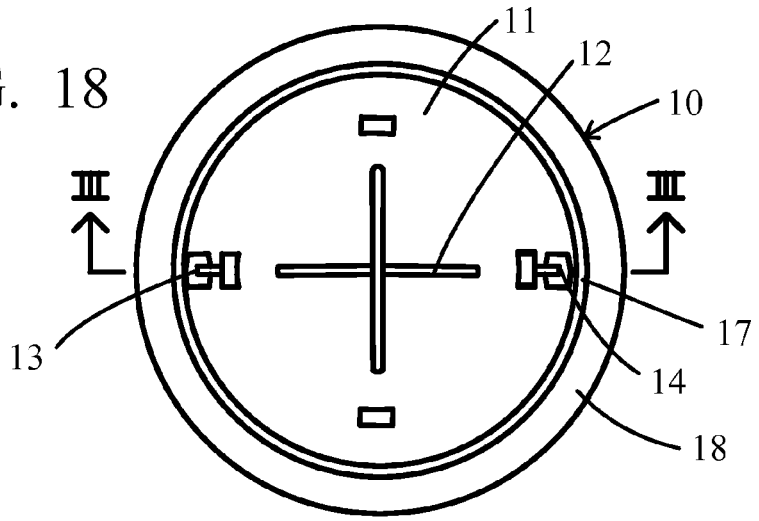
FIG. 18 is a front elevation view, in section as seen along line 18-18 of FIG. 19, of a sealable lower, outside end of a vent, without the sealing plug in place.

FIG. 18 shows a plan view of the wellhead vault shown in FIGS. 16 and 17. The lifting bars can be shown extending outward from each of the tubes that form the lifting bores. The unused tubes that form lifting bars are shown extending forward and backward from the sides of the wellhead vault.

Figure 19:
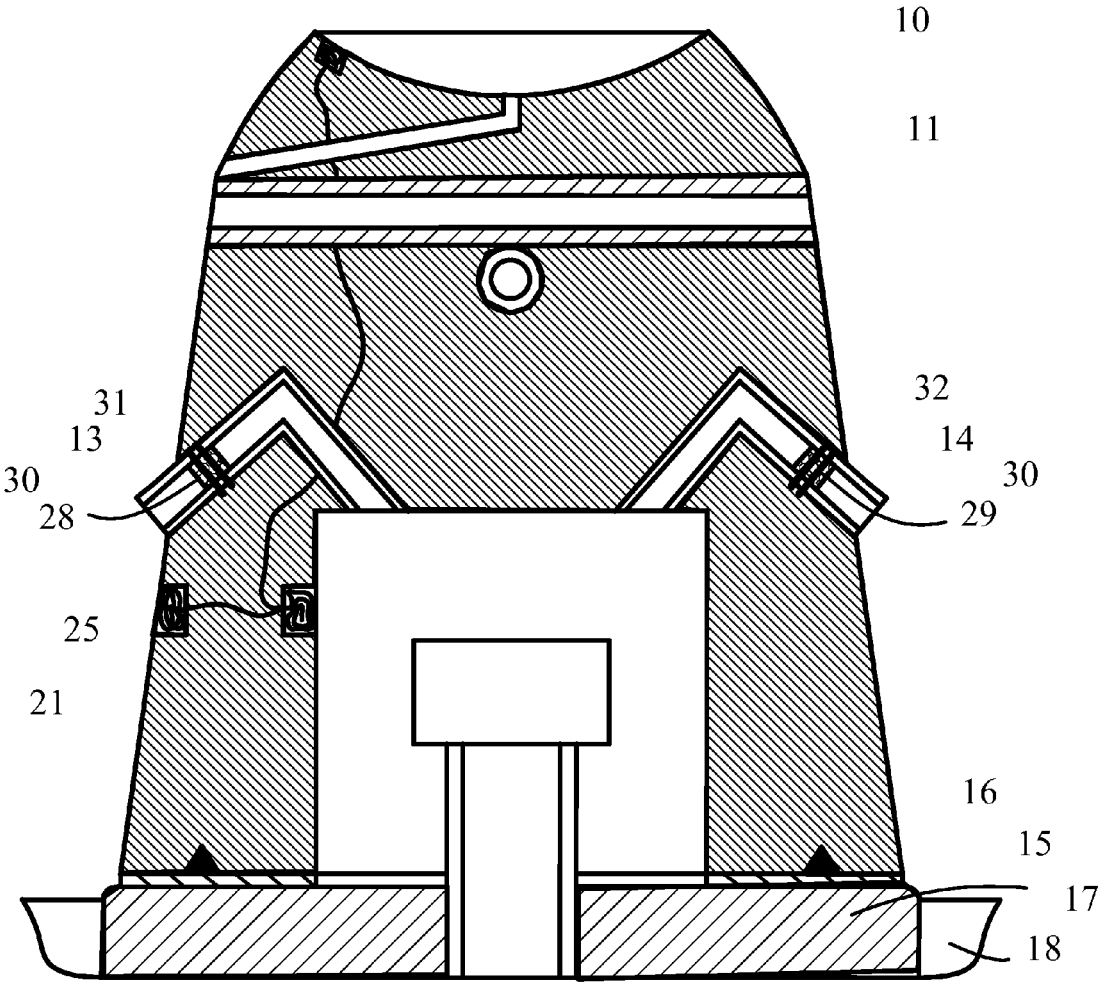
FIG. 19 is a right elevation view of the sealable lower, outside end of the vent shown in FIG. 18, without the sealing plug in place.

FIG. 19 shows another version of the invention. In this case, the top of the wellhead vault has a concavity facing upward with a drain running out of the bottom of the can cavity and capable of draining any liquid in the concavity unless a plug is placed in the drain to keep the liquid from and draining out. This cavity can cavity can act as a bird bath or can act as a planter on top of the wellhead a vault. This version also includes a cast-in wiring system with a junction box on the outside of the wellhead vault and electrical connection to a junction box on the wall of the chamber, and electrically connected to the can cavity at the top of the wellhead vault. This wiring system allows the provision of electricity from the outside of the wellhead vault to various devices associated with the chamber or top can cavity. This version also includes a circular groove with a triangular cross-section formed in the lower surface of the wellhead vault and adjacent the outside edge of the bottom of the wellhead vault. This groove can be filled with a sealant prior to installation of the wellhead dome in order to enhance the ability of the wellhead vault to prevent liquid and other intrusion into the chamber of the wellhead vault.

Figure 20:
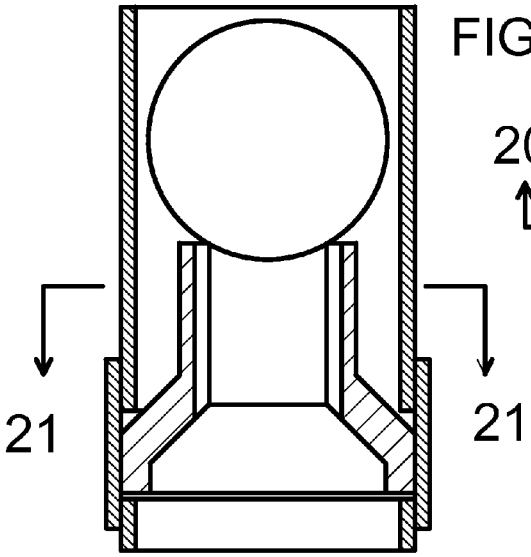
FIG. 20 is a front elevation view, in section as seen along line 20-20 of FIG. 21, of a sealable lower, outside end of the the vent shown in FIG. 18, with the sealing plug in place.
Figure 21:
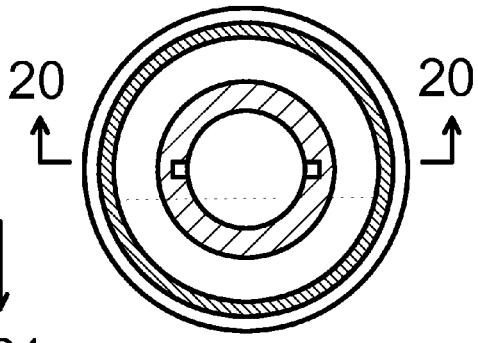
FIG. 21 is a right elevation view of the sealable lower, outside end of the vent shown in FIG. 20, with the sealing plug in place.

FIG. 20 shows a front elevation cross-sectional view, taken a along line 20-20 of FIG. 21, of another version of the lower end of the check valve. In this case, the check valve ball sits on a valve seat in which are carved internal grooves so that air can pass in and out of the check valve while the check valve ball is in its lower position.

FIG. 21 shows a plan view in partial section, taken along line 21-21 of FIG. 20, of the c check valve seat shown in Figure, showing the grooves on the inside of the check valve seat.

Figure 23:
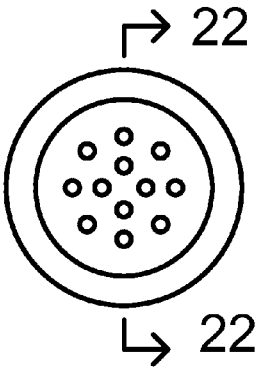
FIG. 23 shows a right elevation view of the vent shown in FIG. 22, and shows the perforated disk in the bore of the vent.

22 shows an front elevation cross-sectional view, taken along 22-22 of FIG. 23, of the outside end of the venting system. FIG. 2 shows a perforated disk fixed in the bore of the venting system to allow air and liquid to enter and leave the venting system, but to prevent any large objects from getting into the venting system.

Figure 22:
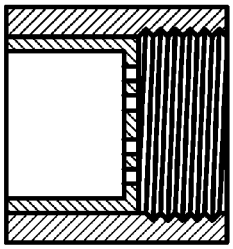
FIG. 22 shows an front elevation cross-sectional view, taken along 22-22 of FIG. 23, of the outside end of the venting system.

FIG. 23 shows a right elevation view of the vent and shown in FIG. 22, and shows the perforated disk in the bore of the vent.

Figure 24:
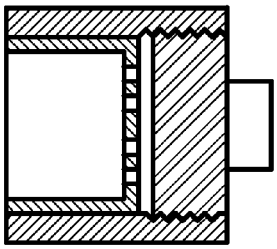
FIG. 24 shows an front elevation cross-sectional view, taken along 24-24 of FIG. 25, of the outside end of the venting system.

FIG. 24 shows an front elevation cross-sectional view, taken along 24-24 of FIG. 23, of the outside end of the venting system. FIG. 2 shows a threaded plug that is removably positioned in the bore of venting system to stop air and liquid from entering or leaving the venting system, in the case of anticipated flood conditions. The plug has a protuberance that allows the plug to be driven into and out of the vent bore.

Figure 25:
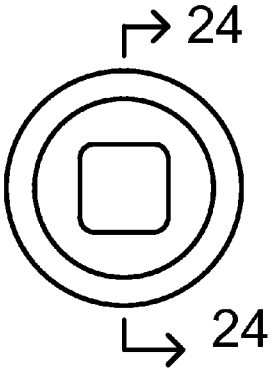
FIG. 25 shows a right elevation view of the vent and plug and shown in FIG. 24.

FIG. 25 shows a right elevation view of the vent and plug and shown in FIG. 24.

Figure 26:
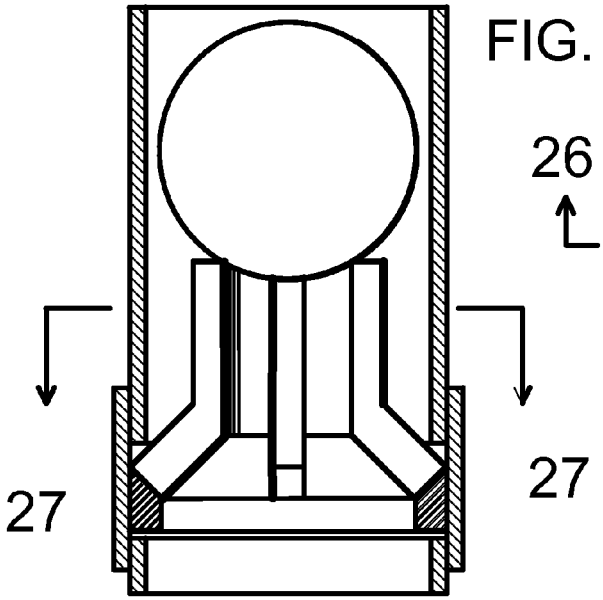
FIG. 26 shows a front elevation cross-sectional view, taken a along line 26-26 of FIG. 27, of another version of the lower end of the check valve.
Figure 27:
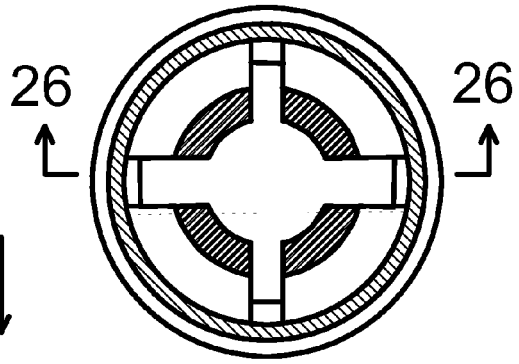
FIG. 27 shows a plan view in partial section, taken along line 27-27 of FIG. 26, of the check valve seat shown in FIG. 26, showing the grooves through the barrel of the check valve seat.

FIG. 26 shows a front elevation cross-sectional view, taken a along line 26-26 of FIG. 27, of another version of the lower end of the check valve. In this case, the check valve ball sits on a valve seat in which are carved four grooves all the way through the barrel of the valve seat, so that air can pass in and out of the check valve while the check valve ball is in its lower position. The grooves are carved all the way down to the base of the valve seat barrel, with a inward sloping bottom surface, so that liquid that accumulates outside the barrel and above the base will drain into the bore of the vent and out the outside vent opening.

FIG. 27 shows a plan view in partial section, taken along line 27-27 of FIG. 26, of the check valve seat shown in FIG. 26, showing the grooves through the barrel of the check valve seat.

Figure 28:
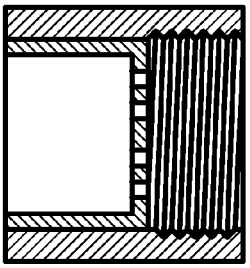
FIG. 28 shows an front elevation cross-sectional view, taken along 28-28 of FIG. 29, of the outside end of the venting system.
Figure 29:
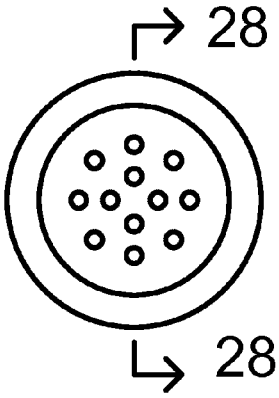
FIG. 29 shows a right elevation view of the vent and shown in FIG. 28, and shows the perforated disk in the bore of the vent.

FIG. 28 shows an front elevation cross-sectional view, taken along 28-28 of FIG. 29, of the outside end of the venting system. FIG. 2 shows a perforated disk fixed in the bore of the venting system to allow air and liquid to enter and leave the venting system, but to prevent any large objects from getting into the venting system.

FIG. 29 shows a right elevation view of the vent and shown in FIG. 28, and shows the perforated disk in the bore of the vent.

Figure 30:
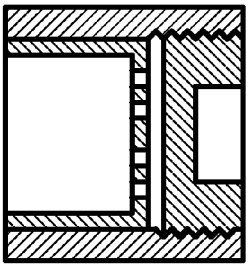
FIG. 30 shows an front elevation cross-sectional view, taken along 30-30 of FIG. 31, of the outside end of the venting system.
Figure 31:
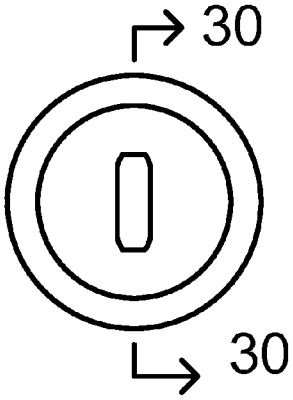
FIG. 31 shows a right elevation view of the vent and plug and shown in FIG. 30.

FIG. 30 shows an front elevation cross-sectional view, taken along 30-30 of FIG. 31, of the outside end of the venting system. FIG. 30 shows a threaded plug that is removably positioned in the bore of venting system to stop air and liquid from entering or leaving the venting system, in the case of anticipated flood conditions. The plug has a indentation that allows the plug to be driven into and out of the vent bore.

FIG. 31 shows a right elevation view of the vent and plug and shown in FIG. 24.

Figure 32:
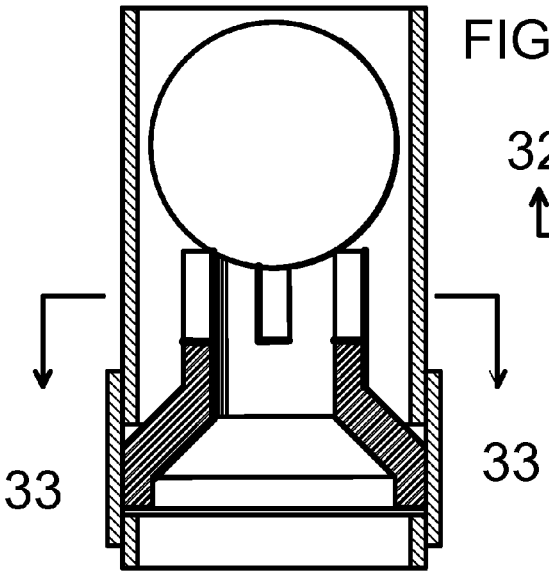
FIG. 32 shows a front elevation cross-sectional view, taken a along line 32-32 of FIG. 33, of another version of the lower end of the check valve.
Figure 33:
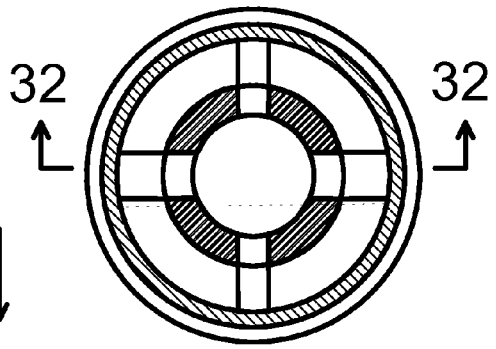
FIG. 33 shows a plan view in partial section, taken along line 33-33 of FIG. 32, of the check valve seat shown in FIG. 32, showing the grooves through the barrel of the check valve seat.

FIG. 32 shows a front elevation cross-sectional view, taken a along line 32-32 of FIG. 33, of another version of the lower end of the check valve. In this case, the check valve ball sits on a valve seat in which are carved four grooves a portion of the way down the barrel of the valve seat, so that air can pass in and out of the check valve while the check valve ball is in its lower position.

FIG. 33 shows a plan view in partial section, taken along line 33-33 of FIG. 32, of the check valve seat shown in FIG. 32, showing the grooves through the barrel of the check valve seat.

Figure 34:
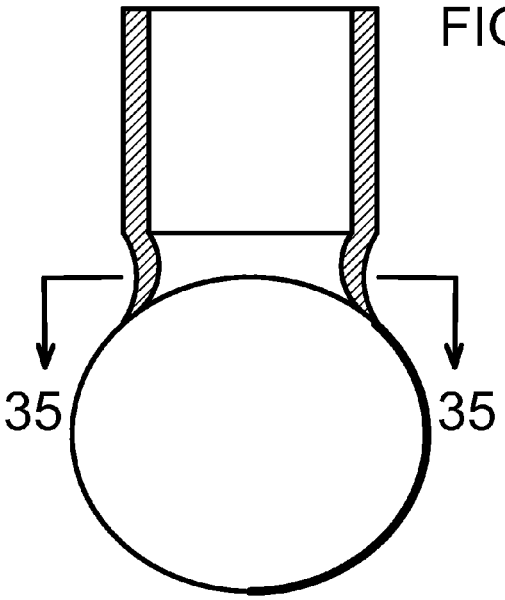
FIG. 34 is front elevation view in partial section, taken along line 34-34 of FIG. 35, of the upper part of a version of a check valve.
Figure 35:
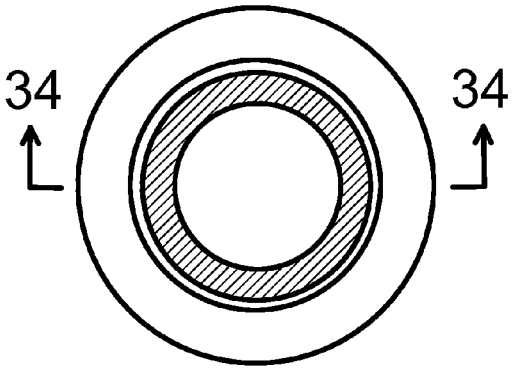
FIG. 35 is a plan view, in section taken line 35-35 of FIG. 34, of the version of the upper part of the check valve shown in FIG. 34.

FIG. 34 is front elevation view, in section taken along line 34-34 of FIG. 35, of the upper part of a version of a check valve. As the ball floats up, it engages a downwardly-facing toroidal lip that forms a tight circular liquid seal with the ball, and prevents liquid from passing through the vent.

FIG. 35 is a plan view, in section taken line 35-35 of FIG. 34, of the version of the upper part of the check valve shown in FIG. 34.

Figure 36:
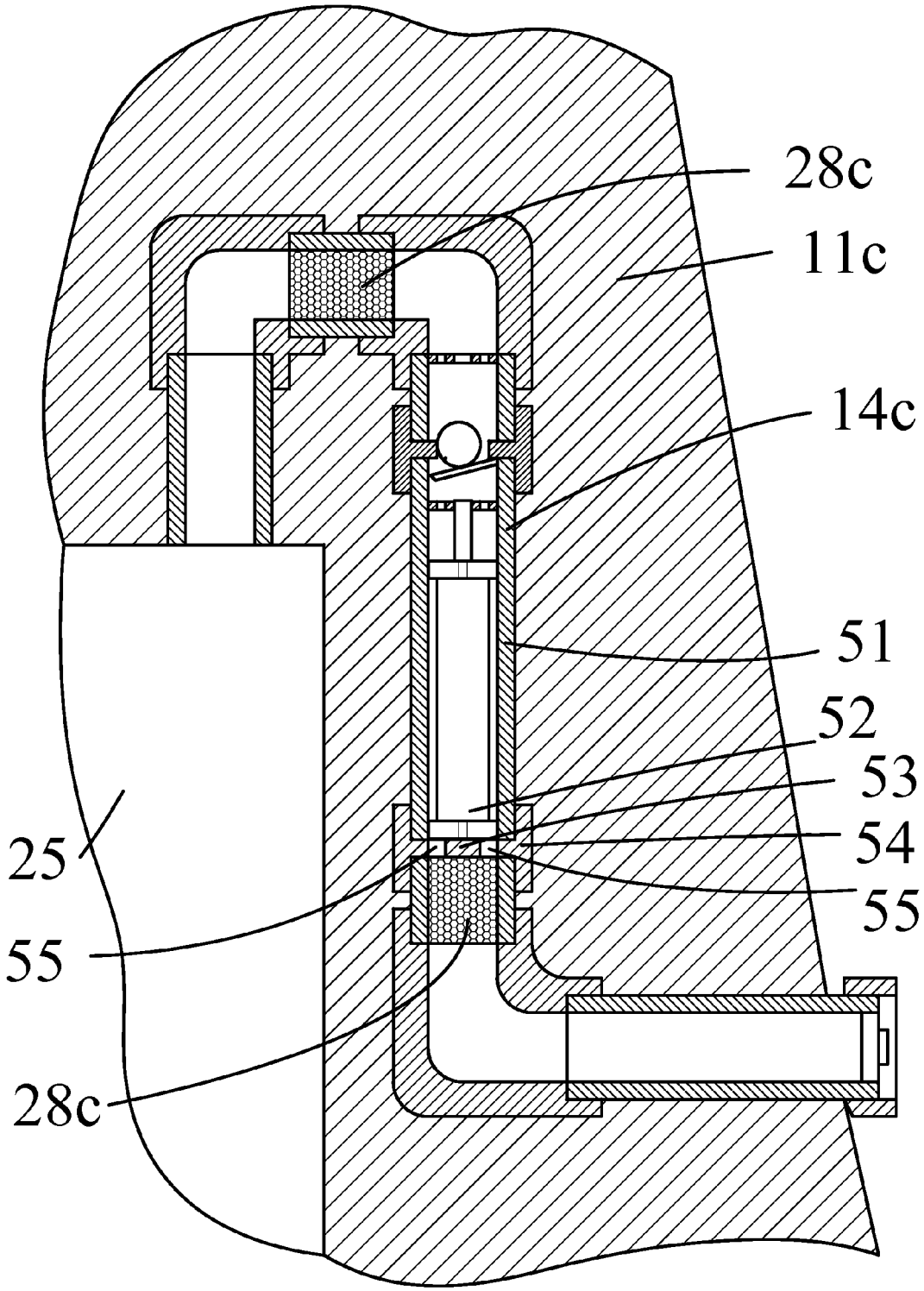
FIG. 36 is a front elevation view, in section taken along line III-III of FIG. 18, showing another version of the vent, with a sealing flap in an unsealed position, and an outlet seal in place to seal the outlet when flooding is expected.

FIG. 36 is a front elevation view, in section taken along line III-III of FIG. 18, showing another version of the vent, with a sealing flap in an unsealed position, and an outlet seal in place to seal the outlet when flooding is expected.

Figure 37:
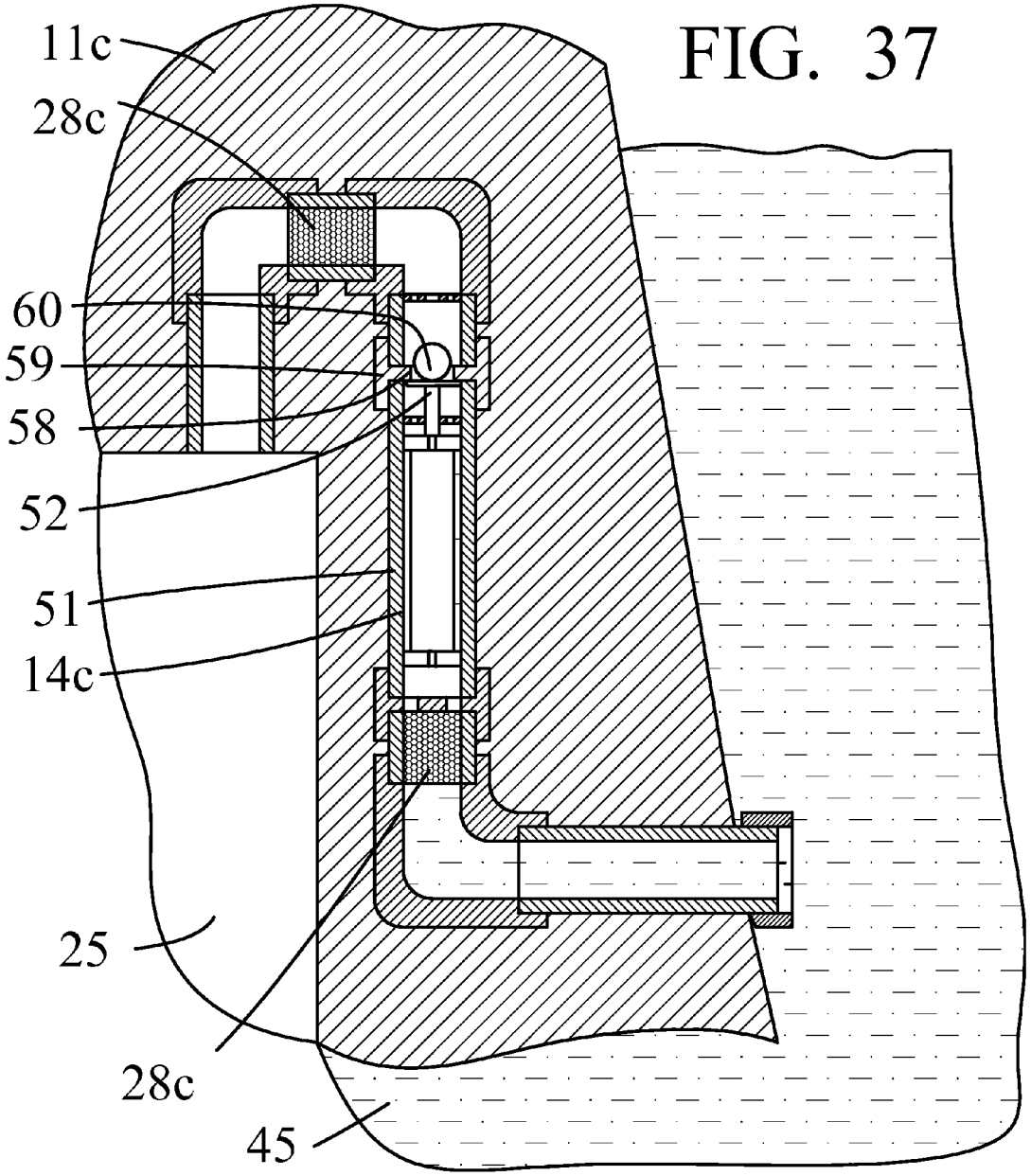
FIG. 37 is a front elevation view, in section taken along line III-III of FIG. 18, showing the vent in FIG. 36, with the sealing flap in a sealed position, and the outlet seal not in place to seal the outlet, when flooding is not expected.

FIG. 37 is a front elevation view, in section taken along line III-III of FIG. 18, showing the vent in FIG. 36, with the sealing flap in a sealed position, and the outlet seal not in place to seal the outlet, when flooding is not expected.

This version of the valve addresses a possible issue that might occur in certain environmental conditions. As in the other versions of the vent, the vent is intended to allow air flow between the inside and outside of the vault, without letting anything, especially liquids, else in.

In some environments, flooding conditions are extremely turbulent, with extreme variations in pressure applied to the vent. In such a case, it may be advantageous to apply increased closing pressure on the sealing elements in the vent. One way to do this is to increase the volume of the float that is pressing the sealing element into a closed position. One way to accomplish this is to shape the float as an elongated circular cylinder. In that way, the volume, and therefore the buoyancy, and therefore the sealing power of the float, is increased without having to increase the diameter of the vent.

One the special aspects of this cylindrical float configuration is that it works best if the outer diameter of the float is significantly less than the inner diameter of the vent, and there is a flange at the top and bottom of the float to keep the float centered in the vent lumen. The flanges must have openings to let air and water flow through the vents and around the float.

Below the lower end of the float is a stationary platform with openings to allow liquids and gasses to pass through. At the upper end of the float is an upwardly-directed vertical shaft which is designed so that when the float moves up, the upper end of the vertical shaft will cause a sealing flap to close. The shaft is maintained in a position coaxial to the vent by means of a stationary plate through which the shaft passes. The plate includes openings to allow gas and liquid to pass through the plate. The stationary plate also prevents the float from traveling too far up the vent in the case of extreme pressure conditions.

Above the shaft is a downwardly open sealing flap positioned to seal with a stationary valve seat when the sealing flap is pressed upward by the shaft.

FIG. 36 shows the float in its lower position, with the valve flap down and unsealed, to allow air flow in and out of the vault.

FIG. 37 shows the float in its upper or floating position, with the valve flap up and sealed to prevent liquids from entering the vault.

Another feature that is present in this new version is a weighted ball that keeps the sealing flap from remaining closed when a closed sealing flap is not desirable. The ball is confined in a cage defined by the sealing flap and sealing seat, the bottom, a stationary porous plate at the top that does not allow the ball to escape the cage, and the walls of the vent, It may be that the enhanced sealing power provided by the above described cylindrical float may be so great that the sealing flap sticks and remains sealed even when the need for the seal is no longer present. By selecting a downwardly opening sealing flap and placing a weighted ball on top of the flap, any tendency for the seal to stick in its closed position is overcome by the weight of the ball.

FIG. 36 shows the float in its lower position, with the valve flap down and unsealed, and the weighted ball on the flap and biasing the flap down and unsealed.

FIG. 37 shows the float in its upper position, with the valve flap up and sealed, and the weighted ball on the flap. The ball is light enough to allow the flap to be closed by the float, so that the flap can make the seal when desired.

Figure 38:
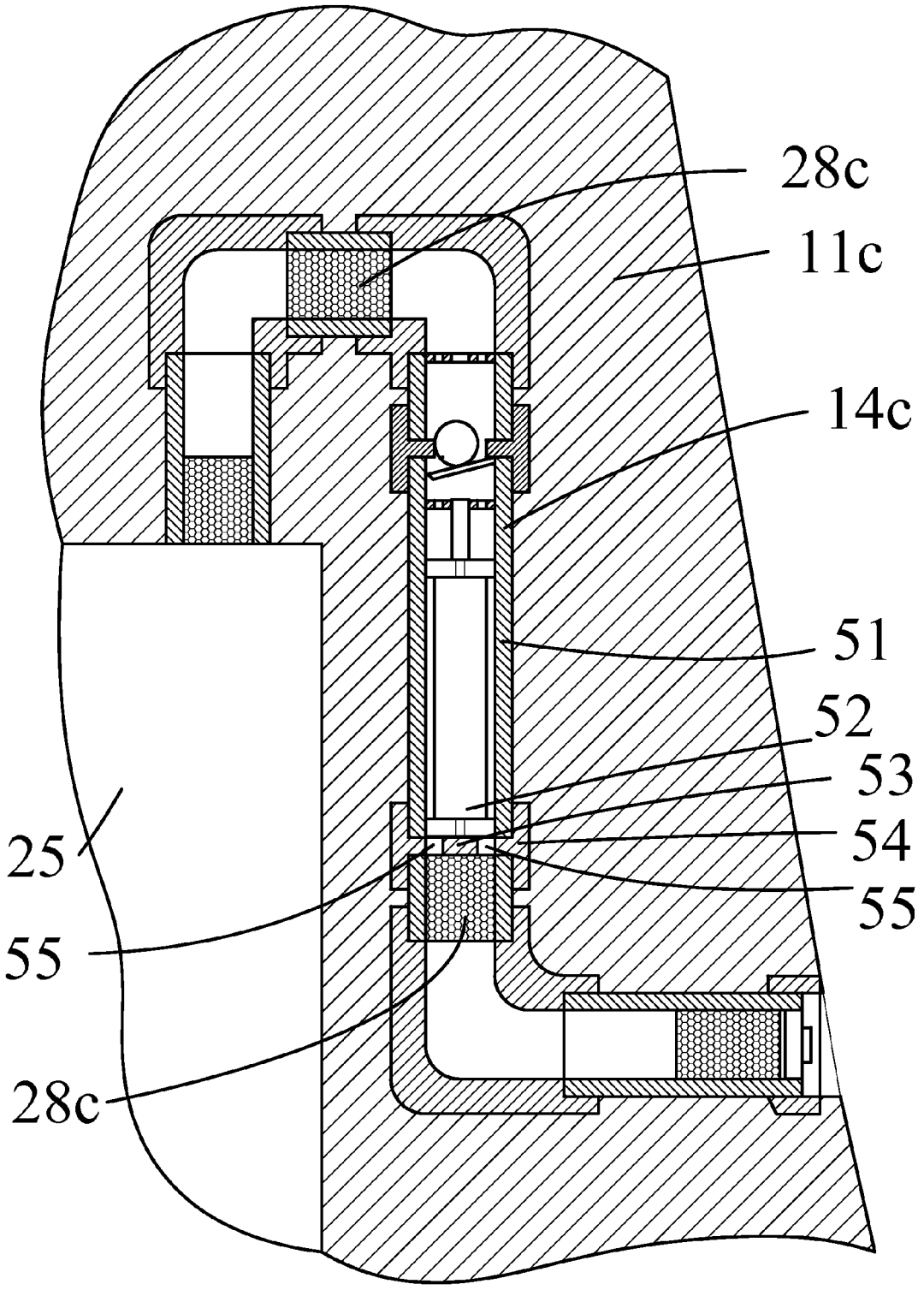
FIG. 38 is a front elevation view, in section taken along line III-III of FIG. 18, showing another version of the vent shown in FIG. 36, with a sealing flap in an unsealed position, and an outlet seal in place to seal the outlet when flooding is expected.

FIG. 38 shows, a variation of the design shown in FIG. 36. In the variation, the outer end of the vent is inset from the outer wall of the vault so that the outer end of the vent cannot be damaged by debris floating by the outside of the vault. Also adjacent the outer end of the vent, is an additional screening trap which keeps animals and other debris from entering the vent when the is not on the vent. The inside end of the vent also includes an additional screening trap that keeps animals and debris from entering the vent during transport or storage of the on applied vent or when the vent is integrated into the vault. It has been found that increasing the volume of the float has a dramatic effect on the effectiveness of the sealing of the valve that is closed by the float. In the preferred embodiment, the float has an outer diameter of 4 inches, and the piping around the float has a 5 inch inner diameter. The seal ball is preferably rubber, elastomer, or glass, depending on environmental conditions.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desire to secure by Letters Patent is:

1. An anti-alteration well connection comprising:

a) a water supply wellhead protruding from dry ground, and b) a water wellhead vault enclosing the water supply wellhead, i) the water wellhead vault constructed in a manner so as to make access to the water wellhead by penetrating the vault wall or by moving the vault prohibitive without the use of heavy equipment, ii) the water wellhead vault comprising a wall surrounding the water supply wellhead, closed at the top and open at the bottom, the water wellhead vault including an outer wall and an inner wall, the inner wall defining an inner chamber, iii) the water wellhead vault including an air vent comprising a bore with an outer end beginning at the outer wall of the water wellhead vault and an inner end opening at the inner wall into the inner chamber and providing air flow to the water wellhead, the bore specifically oriented upward towards the inner chamber, the orientation of the bore preventing liquid from being poured therein, and iv) the water wellhead vault being positioned such to securely enclose the water supply wellhead within the inner chamber, thereby prohibiting alteration of the water wellhead without the use of heavy equipment.

2. The anti-alteration well connection as recited in claim 1, wherein the outer end of the air vent is inset from the outer wall of the water wellhead vault.

3. The anti-alteration well connection as recited in claim 1, wherein a screening trap covers the entrance of the air vent, the screening trap capable of preventing the infiltration of animals or debris into the air vent when the water wellhead vault is in service.

4. The anti-alteration well connection as recited in claim 1, wherein a screening trap is installed within the entrance of the air vent, the screening trap capable of preventing the infiltration of animals or debris into the air vent when the water wellhead vault is in service.

5. The anti-alteration well connection as recited in claim 1, wherein the air vent is provided with a first check ball valve and a second check ball valve, each check ball valve including a check valve barrel having a barrel seat into which a float ball is buoyantly pressed when water infiltrates the air vent , the first check ball valve installed towards the outer end of the air vent providing primary protection against flood water infiltrating the water wellhead vault and the second check ball valve installed between the first check ball valve and the inner end of the air vent, the second check ball valve providing backup protection in case of a partial or complete failure of the first check ball valve.

6. The anti-alteration well connection as recited in claim 5, wherein at least one of the check valve barrel seats are provided with grooves.

7. The anti-alteration well connection as recited in claim 5, wherein at least one of the check ball valves is provided with a sealing flap which is buoyantly pressed closed by the float ball when liquid infiltrates the air vent, the closure of the sealing flap preventing the liquid infiltration beyond the sealing flap.

8. The anti-alteration well connection as recited in claim 7, wherein the check valve includes a cylindrical float which presses the sealing flap into a closed position, the outer diameter of the cylindrical float being significantly less than the inner diameter of the vent, and a first flange integral to the cylindrical float and proximate to the top of the cylindrical float and a second flange integral to the cylindrical float and proximate to the bottom of the cylindrical float, each flange having a diameter slightly less than the diameter of the vent, the flanges keeping the float centered in the vent lumen, the flanges each provided with an opening to allow air and water to flow through the vents and around the float.

9. The anti-alteration well connection as recited in claim 8, wherein below the cylindrical float is a stationary platform with openings to allow liquids and air to pass through, and at the upper end of the cylindrical float is an upwardly directed vertical shaft which, when the cylindrical float moves upward, pushes the sealing flap closed, the shaft being maintained in a position coaxial to the vent by means of a stationary plate through which the shaft passes, the plate including openings to allow air and liquid to pass through, and the plate forming a barrier to restrict the upward movement of the cylindrical float.

10. The anti-alteration well connection as recited in claim 8, wherein a downwardly open sealing flap is postioned above the shaft and acts in conjunction with a stationary valve seat to seal the air vent when the sealing flap is pressed upward by the cylindrical float shaft.

11. The anti-alteration well connection as recited in claim 10, wherein the air vent includes a weighted ball resting above the sealing flap and which prevents the sealing flap from remaining closed when the sealing flap is not under pressure from the buoyantly rising cylindrical float, but which weighted ball is light enough to allow the shaft pressure to close the flap securely when buoyantly rising under the influence of infiltrating liquid, the weighted ball being confined to a cage defined by a bottom portioned formed by the sealing flap and sealing seat, a top portion formed by the stationary porous plate restricting upward movement of the weighted ball, and a side portion formed by the walls of the air vent.

12. The anti-alteration well connection as recited in claim 8, wherein the cylindrical float has an outer diameter of 4 inches and the air vent piping around the float has a 5 inch inner diameter.

13. The anti-alteration well connection as recited in claim 5, wherein at least one of the float balls, when not buoyantly floating in a liquid which has infiltrated the air vent, sits on a lower valve seat in which are carved internal grooves, the internal grooves constructed in a manner which allows air to pass around the check valve float ball and therefore in and out of the inner chamber.

14. The anti-alteration well connection as recited in claim 5, wherein the check valve float ball sits on a valve seat in which are carved four grooves all the way through the barrel of the valve seat, allowing air to pass by the check valve while the check valve float ball is in its lower position, the grooves carved all the way down to the base of the check valve barrel with an inward sloping bottom surface, allowing accumulated liquid outside the barrel and above the base to drain into the bore of the air vent and out beyond the outer end of the air vent.

15. The anti-alteration well connection as recited in claim 5, wherein the check valve float ball upon buoyantly floating upwards under the influence of infiltrating liquid, engages a downwardly-facing toroidal lip, creating a liquid tight seal between the bouyantly risen float ball and the downwardly-facing toroidal lip, preventing the infiltrating liquid from passing beyond the lip.

16. The anti-alteration well connection as recited in claim 5, wherein the float ball is made of one of the following materials: rubber, elastomer, or glass.

17. The anti-alteration well connection as recited in claim 1, wherein the air vent is provided with a sealing plug which is capable of sealing the lower outer end of the air vent in order to prevent flood water from infiltrating the water wellhead vault.

18. The anti-alteration well connection as recited in claim 17, wherein the sealing plug is threaded, is removably positioned in the bore of the venting system, is capable of stopping air and liquid from entering or leaving the venting system, and includes a proturbance or indentation with which the sealing plug can be driven into or removed from the air vent bore.

19. The anti-alteration well connection as recited in claim 1, wherein the air vent is provided with a perforated disk in the bore of the vent situated close to the outside opening of the air vent.

20. The anti-alteration well connection as recited in claim 1, wherein the water wellhead vault includes tubing set in the wellhead vault wall creating two bores which pass through the upper portion of the water wellhead vault and which bores are suitable for the insertion of straight lifting bars, which bars having a strength capacity suitable for lifting the weight of the water wellhead vault.

21. The anti-alteration well connection as recited in claim 1, wherein the top portion of the water wellhead vault includes a concavity facing upward with a drain running out of the bottom of the concavity capable of draining liquid that has accumulated in the concavity, including a drain plug capable of stopping liquid from draining out of the concavity.

22. The anti-alteration well connection as recited in claim 1, wherein the water wellhead vault includes a cast-in wiring system, including a junction box on the outside surface of the water wellhead vault, an electrical connection to a junction box on the inner wall of the vault inner chamber, the cast-in wiring system electrically connected to the concavity at the top of the water wellhead vault, providing electricity from the outside of the water wellhead vault to various devices associated with the water wellhead vault inner chamber or to the top concavity.

23. The anti-alteration well connection as recited in claim 1, wherein the water wellhead vault includes a circular groove with a triangular cross-section formed in the bottom surface of the water wellhead vault and which groove is formed adjacent to the outside edge of the bottom of the water wellhead vault, and which groove is capable of being filled with a sealant prior to installation of the wellhead vault.

* * * * *